US009874356B2

(12) United States Patent
Jeong et al.

(10) Patent No.: US 9,874,356 B2
(45) Date of Patent: Jan. 23, 2018

(54) VENTILATION APPARATUS AND COOKING SYSTEM HAVING THE SAME

(71) Applicants: Samsung Electronics Co., Ltd., Suwon-si (KR); SOGANG UNIVERSITY RESEARCH AND BUSINESS FOUNDATION, Seoul (KR)

(72) Inventors: Hyun Ku Jeong, Yongin-si (KR); Kyu Suk Lee, Suwon-si (KR); Kyu Ho Shin, Seoul (KR); Jin Ho Lee, Suwon-si (KR); Moon Il Jung, Suwon-si (KR); Jung Hee Lee, Seoul (KR); Nahm Keon Hur, Seoul (KR)

(73) Assignees: SAMSUNG ELECTRONICS CO., LTD., Suwon-si (KR); SOGANG UNIVERSITY RESEARCH AND BUSINESS FOUNDATION, Seoul (KR)

( * ) Notice: Subject to any disclaimer, the term of this patent is extended or adjusted under 35 U.S.C. 154(b) by 722 days.

(21) Appl. No.: 13/679,267

(22) Filed: Nov. 16, 2012

(65) Prior Publication Data

US 2013/0125764 A1 May 23, 2013

(30) Foreign Application Priority Data

Nov. 17, 2011 (KR) ..... 10-2011-0120288

(51) Int. Cl.
*F24C 15/20* (2006.01)

(52) U.S. Cl.
CPC ..... *F24C 15/2035* (2013.01); *F24C 15/2028* (2013.01); *F24C 15/2042* (2013.01); *F24C 15/2078* (2013.01)

(58) Field of Classification Search
CPC ..... F24C 15/2042; F24C 15/2078; F24C 15/2035; F24C 15/2028
(Continued)

(56) References Cited

U.S. PATENT DOCUMENTS 2,185,919 A * 1/1940 Kurth ..... F24F 13/062 454/248
3,386,365 A * 6/1968 Jensen ..... F24C 15/2028 126/299 E
(Continued)

FOREIGN PATENT DOCUMENTS

DE 7203902 9/1973
DE 4335106 A1 * 4/1994 ..... B08B 15/02
(Continued)

OTHER PUBLICATIONS

Higuchi, Yoshiaki, JP 05180481 A, Jul. 1993, english translation through Advanced Industrial Property Network, (c) JPO and INPIT (Please see Higuchi et al JP 1993-180481A mach transl.pdf).*
(Continued)

*Primary Examiner* — Steven B McAllister
*Assistant Examiner* — Frances F Hamilton
(74) *Attorney, Agent, or Firm* — Staas & Halsey LLP

(57) ABSTRACT

A ventilation system that allows air to be directly discharged to an outside of a ventilation apparatus, the ventilation system including a body and the ventilation apparatus provided at an edge of an upper surface of the body and configured to take in polluted air generated during cooking, wherein the ventilation apparatus includes a suction port configured to take in the polluted air, a suction fan provided at an inside of the body and configured to generate a suction force for the polluted air to be taken in through the suction port, a passage through which the air taken in through the suction port passes, at least one filter mounted at an inside
(Continued)

the passage and configured to purify the air passing through the passage, and an exit port communicating with one end portion of the passage and configured to discharge the air purified by the at least one filter indoors.

5 Claims, 21 Drawing Sheets

(58) Field of Classification Search
USPC ..... 454/51, 57, 58, 63, 64, 66, 189, 191; 126/299 R
See application file for complete search history.

(56) References Cited

U.S. PATENT DOCUMENTS 3,583,306 A * 6/1971 Hagdorn ..... B08B 15/02 126/299 D
4,043,257 A * 8/1977 Aaberg ..... B08B 15/02 454/188
4,450,756 A * 5/1984 Kling ..... F24C 15/2028 126/299 D
4,550,650 A * 11/1985 Denner ..... B08B 15/023 454/57
5,042,456 A * 8/1991 Cote ..... F24C 15/2028 126/299 D
5,096,467 A * 3/1992 Matsui ..... B65G 53/24 454/189
5,251,608 A * 10/1993 Cote ..... F24C 15/2028 126/299 D
5,263,897 A * 11/1993 Kondo ..... F24C 15/2028 454/189
5,395,410 A * 3/1995 Jang ..... B01D 45/14 126/299 D
5,868,127 A * 2/1999 Chiang ..... F24C 15/2035 126/299 D
6,044,838 A * 4/2000 Deng ..... F24C 15/2028 126/299 D
6,336,451 B1 * 1/2002 Rohl-Hager ..... B08B 15/02 126/299 D
6,428,408 B1 * 8/2002 Bell ..... B01L 1/50 454/56
6,632,132 B1 * 10/2003 Kikuchi ..... F24C 15/2028 126/299 D
7,959,696 B2 * 6/2011 Martic ..... F24C 15/2028 126/299 F
8,522,770 B2 * 9/2013 Colburn ..... F24C 15/2028 126/299 D
2002/0134371 A1 * 9/2002 Ward ..... F24C 15/2042 126/299 R
2004/0149278 A1 * 8/2004 Lin ..... F24C 15/2035 126/299 R
2006/0090746 A1 * 5/2006 Lee ..... F24C 15/2028 126/299 D
2006/0278215 A1 * 12/2006 Gagas ..... F24C 15/2092 126/299 D
2006/0278216 A1 12/2006 Gagas et al.
2007/0062513 A1 * 3/2007 Gagas ..... F24C 15/2021 126/299 D
2007/0113839 A1 * 5/2007 Lee ..... F24C 15/2028 126/299 D
2009/0211564 A1 * 8/2009 Pan ..... F24C 15/2028 126/299 D
2010/0095949 A1 * 4/2010 Huang ..... F24C 15/2028 126/299 D
2010/0126123 A1 * 5/2010 Martic ..... F24C 15/2028 55/344
2011/0094497 A1 * 4/2011 Schrock ..... F24C 15/2028 126/299 D
2011/0232625 A1 * 9/2011 Corleoni ..... F24C 15/20 126/299 R
2011/0240004 A1 * 10/2011 Corleoni ..... F24C 15/20 126/299 R
2012/0152229 A1 * 6/2012 Huang ..... F24C 15/2028 126/299 R
2013/0008429 A1 * 1/2013 Colburn ..... F24C 15/2028 126/299 D
2013/0220299 A1 * 8/2013 Lee ..... F24C 15/2028 126/299 D

FOREIGN PATENT DOCUMENTS

DE 10052824 A1 * 5/2002 ..... F24C 15/2028
DE 10216012 A1 * 10/2003 ..... F24C 15/2028
DE 202 21 100 U1 3/2005
DE 102005008800 A1 * 8/2006 ..... F24C 15/2028
DE 10 2008 050 723 A1 4/2010
EP 1 118 820 A1 7/2001
EP 1 696 180 A2 8/2006
FR 1 377 610 11/1964
FR 3012579 A1 * 5/2015 ..... F24C 15/2028
JP 05180481 A * 7/1993
JP 2003-207184 7/2003
KR 20-0267257 2/2002
KR 10-2011-0105739 9/2011
WO 99/23421 5/1999
WO 02/49743 A1 6/2002
WO WO 2007121461 A2 * 10/2007 ..... B08B 15/023
WO WO 2009018679 A1 * 2/2009 ..... B08B 15/023
WO 2009/092077 A1 7/2009
WO WO 2014082392 A1 * 6/2014 ..... F24C 15/2042

OTHER PUBLICATIONS

Extended European Search Report for European Application No. 12192505.1, dated Jan. 31, 2013.
European Office Action dated Dec. 19, 2016 in corresponding European Patent Application No. 12 192 505.1.
European Office action dated Jun. 12, 2017 in corresponding European Application No. 12 192 505.1.
Korean Office Action dated Oct. 23, 2017 in corresponding Korean Patent Application No. Oct. 2011-0120288.

* cited by examiner

VENTILATION APPARATUS AND COOKING SYSTEM HAVING THE SAME

CROSS-REFERENCE TO RELATED APPLICATIONS

This application claims the priority benefit of Korean Patent Application No. 10-2011-0120288, filed on Nov. 17, 2011 in the Korean Intellectual Property Office, the disclosure of which is incorporated herein by reference.

BACKGROUND

1. Field

Embodiments relate to a ventilation apparatus capable of easily discharging polluted air and smoke generated during cooking, and a cooking system having the same.

2. Description of the Related Art

In general, a hood configured to take in and discharge polluted air generated at the time of cooking is installed at an upper portion of a gas range.

However, a kitchen island (an island kitchen) separated from a wall is recently in demand.

In a case when a gas range or an electric range is mounted on the kitchen island, the hood, that is, a ventilation apparatus, is not mounted on a ceiling for an aspect of space utilization efficiency and design. Instead, a downdraft is installed on the kitchen island.

In a case when the downdraft hood is mounted, due to the space of a duct to discharge the air or smoke taken in occupies thereon, a space utilization rate is low, an installation of the duct is additionally needed, and additional costs for construction are incurred.

Furthermore, the downdraft hood is generally disposed in parallel to an ascending direction of air or smoke, which provides lower suction efficiency. In order to increase the suction efficiency, the capacity of at suction fan may be increased. However, the noise of the t suction fan may be generated. In addition, the size of a cooking system increases as the size of the suction fan increases.

SUMMARY

In accordance with an aspect of one or more embodiments, there is provided a ventilation apparatus provided with a simplified duct structure by having air discharged to an indoor, and a cooking system having the same.

In accordance with an aspect of one or more embodiments, there is provided a ventilation apparatus provided with increased suction efficiency of the polluted air or smoke, and a cooking system having the same.

In accordance with an aspect of one or more embodiments, there is provided a cooking system includes a body, a heating apparatus and a ventilation apparatus. The heating apparatus may be provided at an upper surface of the body and configured to cook food by applying heat. The ventilation apparatus may be configured to take in polluted air generated during cooking. The ventilation apparatus may include a suction port, a suction fan, a passage, at least one filter, and an exit port. The suction port may be configured to take in the polluted air. The suction fan may be provided at an inside the body and configured to generate a suction force for the polluted air to be taken in through the suction port. The passage may allow the air taken in to pass through the suction port. The at least one filter may be mounted at an inside the passage and configured to purify the air passing through the passage. The exit port may communicate with one end portion of the passage and configured to discharge the air purified by the at least one filter to an indoor.

The at least one filter may include a grease filter to eliminate oil in the polluted air.

The at least one filter may include a filter to eliminate Volatile Organic Compounds (VOCs) included in the polluted air.

The ventilation apparatus may further include a swirl generating unit to generate a swirl at an upper portion of the heating apparatus.

The swirl generating unit may be disposed to at least one side surface of the suction port, and include a discharging hole formed to discharge air toward a front of the ventilation apparatus.

The discharging hole may be configured to discharge air toward an outer side of the side surface of the suction port such that the air is farther away from a center of the suction port.

The passage may be provided with an end portion divided into the exit port and the swirl generating unit such that a portion of the air introduced into the passage flows to the exit port, while another portion of the air flows to the swirl generating unit.

The air introduced into the suction port may be discharged from the swirl generating unit by the suction force of the suction fan.

The swirl generating unit may further include a driving unit configured to provide a driving force to discharge the air from the discharging hole.

The swirl generating unit may include at least one swirler fan mounted at the suction port.

The at least one swirler fan may include a first swirler fan and a second swirler fan.

The cooking system may further include a suction reinforcing unit provided at the upper surface of the body and configured to discharge air toward the suction port.

The passage may be divided so that a portion of the air introduced to the passage is discharged to the suction reinforcing unit.

The air introduced into the suction port may be discharged from the suction reinforcing unit by the suction force of the suction fan.

The suction reinforcing unit may further include a driving unit configured to provide a driving force to discharge air.

In accordance with an aspect of one or more embodiments, there is provided a ventilation apparatus to take in polluted air generated during cooking includes a suction port, a passage, an exit port and at least one filter. The suction port may be configured to take in the polluted air. The passage may be connected to the suction port and through which the polluted air passes. The exit port may be connected to the passage and configured to discharge air to an indoor. The at least one filter may be provided at an inside the passage and configured to purify the air passing through the passage. The polluted air may be purified through the at least one filter and may be discharged through the exit port to an indoor at which the ventilation apparatus is disposed.

The ventilation apparatus may further include at least one swirler fan mounted at the suction port to generate a swirl at a front of the suction port so that the polluted air is taken in.

In accordance with an aspect of one or more embodiments, there is provided a ventilation apparatus to take in polluted air generated during cooking a suction port, a suction fan, a passage and a swirl generating unit. The suction port may be configured to take in the polluted air. The suction fan may be configured to generate a suction force so that the polluted air is taken in to the take in port.

The passage may be connected to the suction port and through which the polluted air passes. The swirl generating unit may be disposed at a side surface of the suction port and configured to generate a swirl at a front of the suction port. The swirl generating unit may be configured to discharge air toward an outer side direction of the side surface of the suction port such that the air is farther away from a center of the suction port.

The passage may be formed in a way to discharge the air, which is introduced into the suction port, from the swirl generating unit by the suction force of the suction fan.

The ventilation apparatus may further include a suction reinforcing unit that is disposed while being spaced apart from the suction port and configured to discharge air toward the suction port.

The passage may be formed in a way that the air, which is introduced into the suction port, is discharged from the suction reinforcing unit by the suction force of the suction fan.

The air taken in may be immediately discharged to an indoor after the air is filtered at a first filter and a second filter, and thus the structure of a duct may be simplified and the space utilization efficiency may be increased.

As polluted air and smoke are taken in by using a swirl, suction efficiency is increased.

BRIEF DESCRIPTION OF THE DRAWINGS

These and/or other aspects will become apparent and more readily appreciated from the following description of embodiments, taken in conjunction with the accompanying drawings of which.

DETAILED DESCRIPTION

Figure 1:
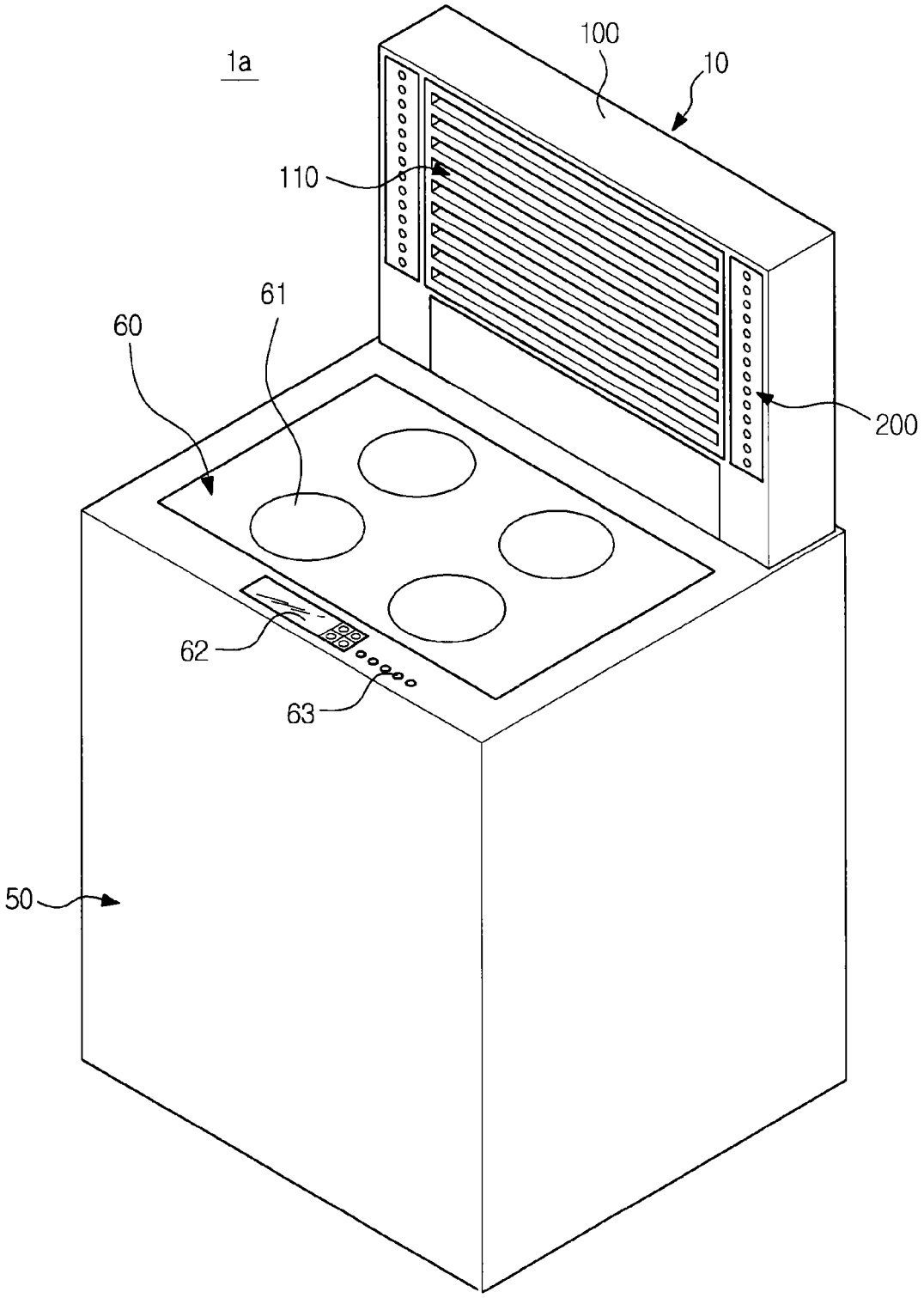
FIGS. 1 and 2 are perspective views illustrating a cooking system in accordance with an embodiment.

Reference will now be made in detail to embodiments, examples of which are illustrated in the accompanying drawings, wherein like reference numerals refer to like elements throughout.

Figure 2:
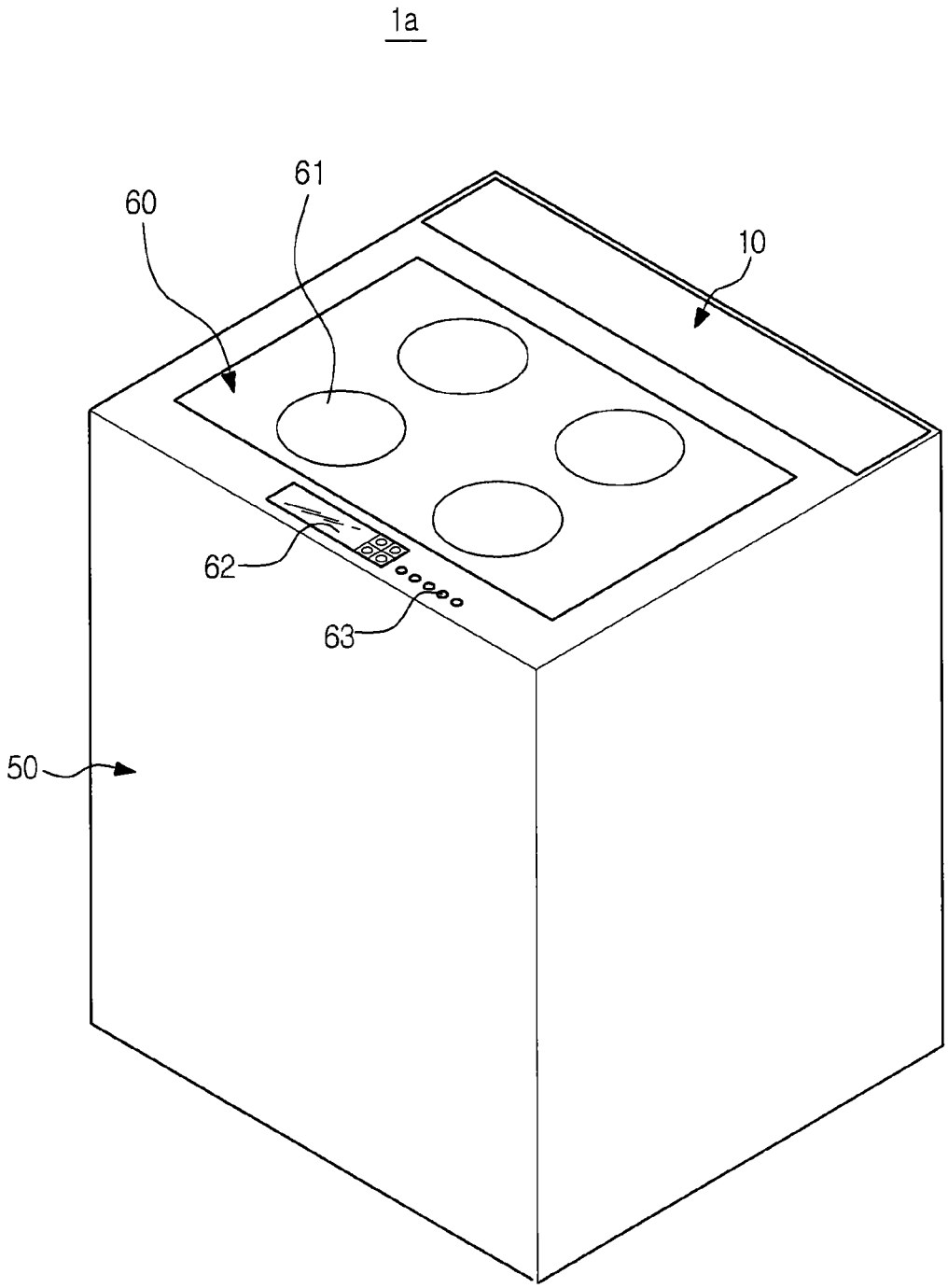

FIGS. 1 and 2 are perspective views illustrating a cooking system in accordance with an embodiment.

As illustrated on FIG. 1, a cooking system 1*a* includes a body 50 forming an exterior of the cooking system 1*a*, a cooking unit 60 formed at an upper surface of the body 50, and a ventilation apparatus 10 mounted at an edge of the upper surface of the body 50.

The cooking unit 60 includes a heating apparatus 61 to directly heat food, a manipulation unit 63 to control the heating apparatus 61, and a display unit 62 to display the state and operation of the heating apparatus 61.

The heating apparatus 61 is configured to apply heat on food or on a cookware containing food by generating high-temperature heat. The heating apparatus 61 of an embodiment is illustrated with an electric range having a flat upper surface thereof and configured to operate through electricity. However, other than the electric range, a gas range or other cooking apparatuses configured to cook food by applying heat may be included in the aspect of the present disclosure.

The ventilation apparatus 10 includes a housing 100 forming an exterior of the ventilation apparatus 10 and configured to accommodate each component, a suction guide 110 disposed at a front of the housing 100, and a swirl generating unit 200 configured to discharge air to generate a swirl. Other than such, although not illustrated on the drawing, the ventilation apparatus 10 includes a passage formed by various ducts.

The ventilation apparatus 10 is protrudedly provided from an upper surface of the body 50 toward an upper direction thereof, and is disposed at a side adjacent to the edge of the upper surface of the body 50.

The ventilation apparatus 10 is configured to take in air, smoke, or smell generated while the heating apparatus 61 cooks foods.

The ventilation apparatus 10, when in operation, maintains the protruded state toward an upper direction of the body 50, but when not in operation, as illustrated on FIG. 2, is inserted into an inside the body 50. That is, when not in operation, the ventilation apparatus 10 is inserted into to a height as nearly as the height of the cooking unit 60. As the ventilation apparatus 60 is inserted into an inside the body 50, the body 50 is provided with orderliness and high space efficiency.

Figure 3:
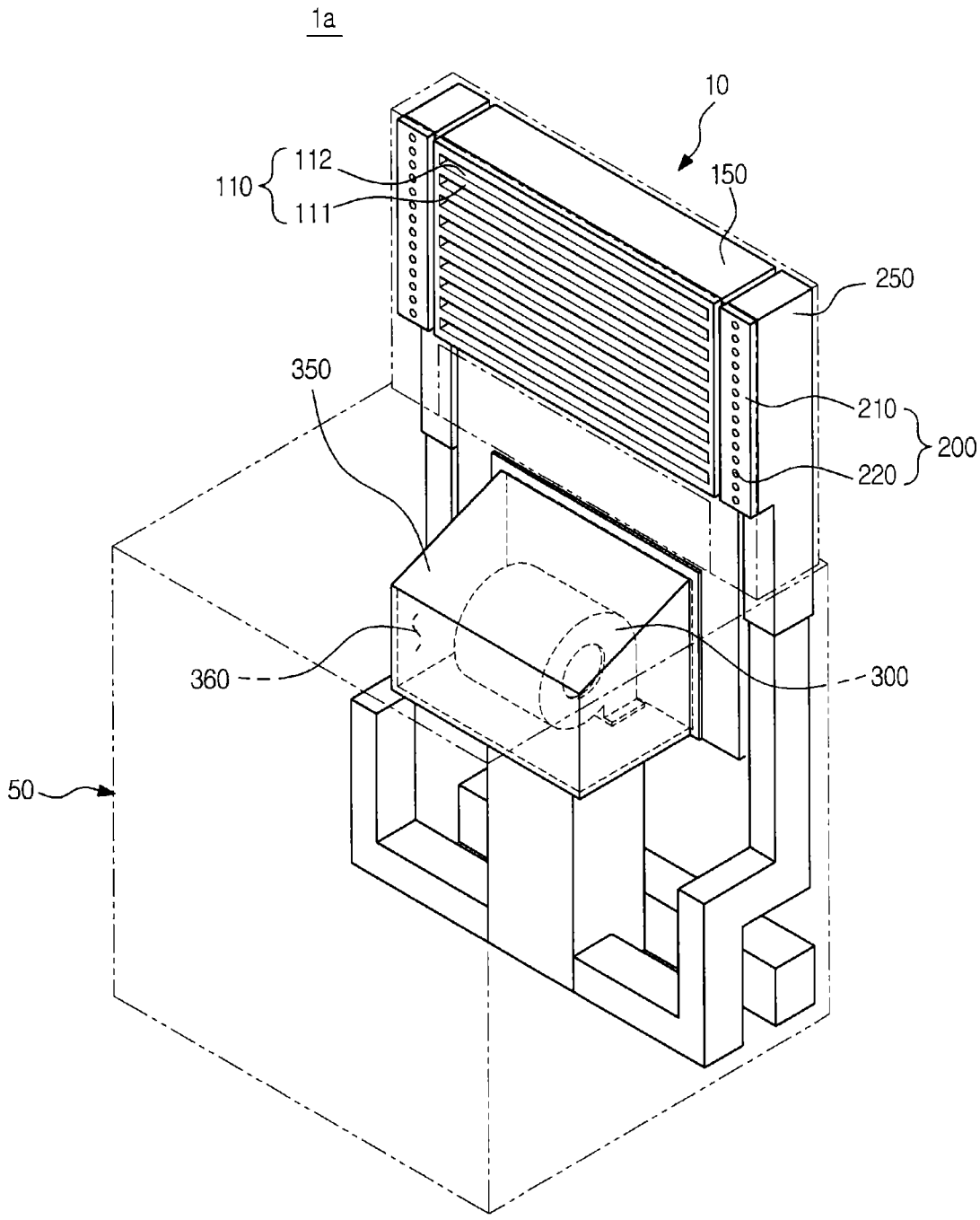
FIG. 3 is a drawing illustrating an inside structure of a body of the cooking system on FIG. 1.
Figure 4:
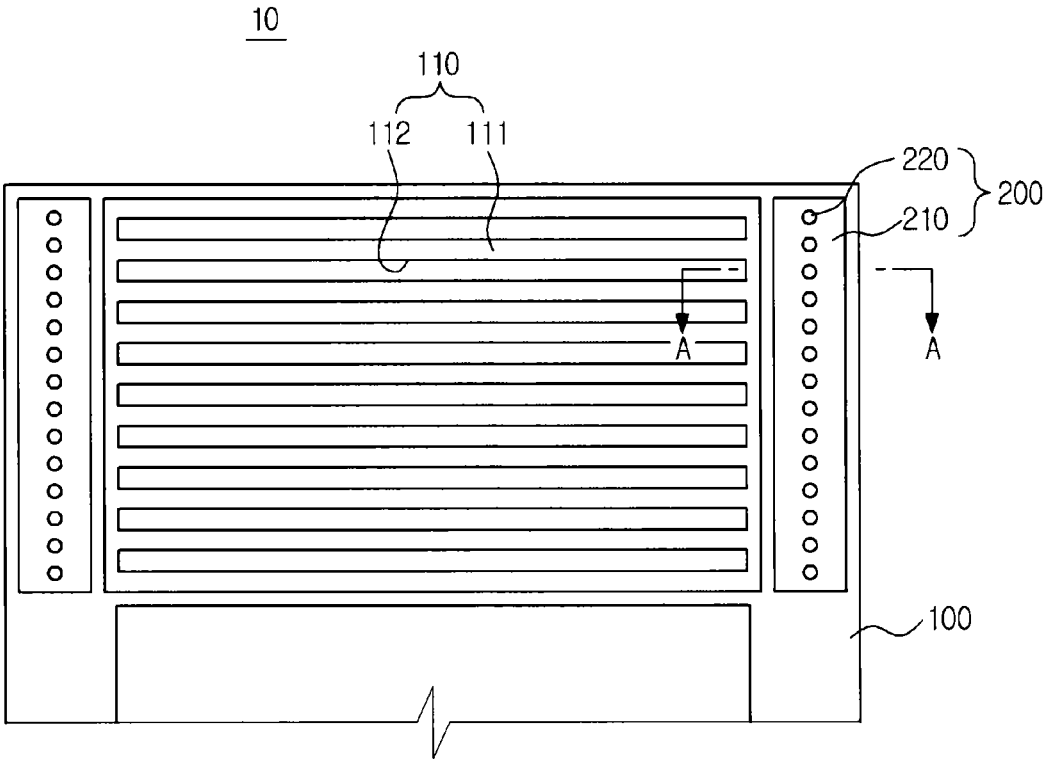
FIG. 4 is a drawing illustrating a ventilation apparatus of FIG. 1.

FIG. 3 is a drawing illustrating an inside structure of a body of the cooking system on FIG. 1. FIG. 4 is a drawing illustrating a ventilation apparatus of FIG. 1.

As illustrated on FIGS. 3 to 4, the housing 100 forms an exterior of the ventilation apparatus 10. Furthermore, the housing 100 is configured to accommodate other components of the ventilation apparatus 10.

A suction port case 150 is disposed inside housing 100 to form a suction port 120 (FIG. 6) through which polluted air is taken in. A front surface of the suction port case 150 is provided with the suction guide 110 mounted thereto to cover the suction port 120 and at the same time, guide the air that is taken in.

Figure 6:
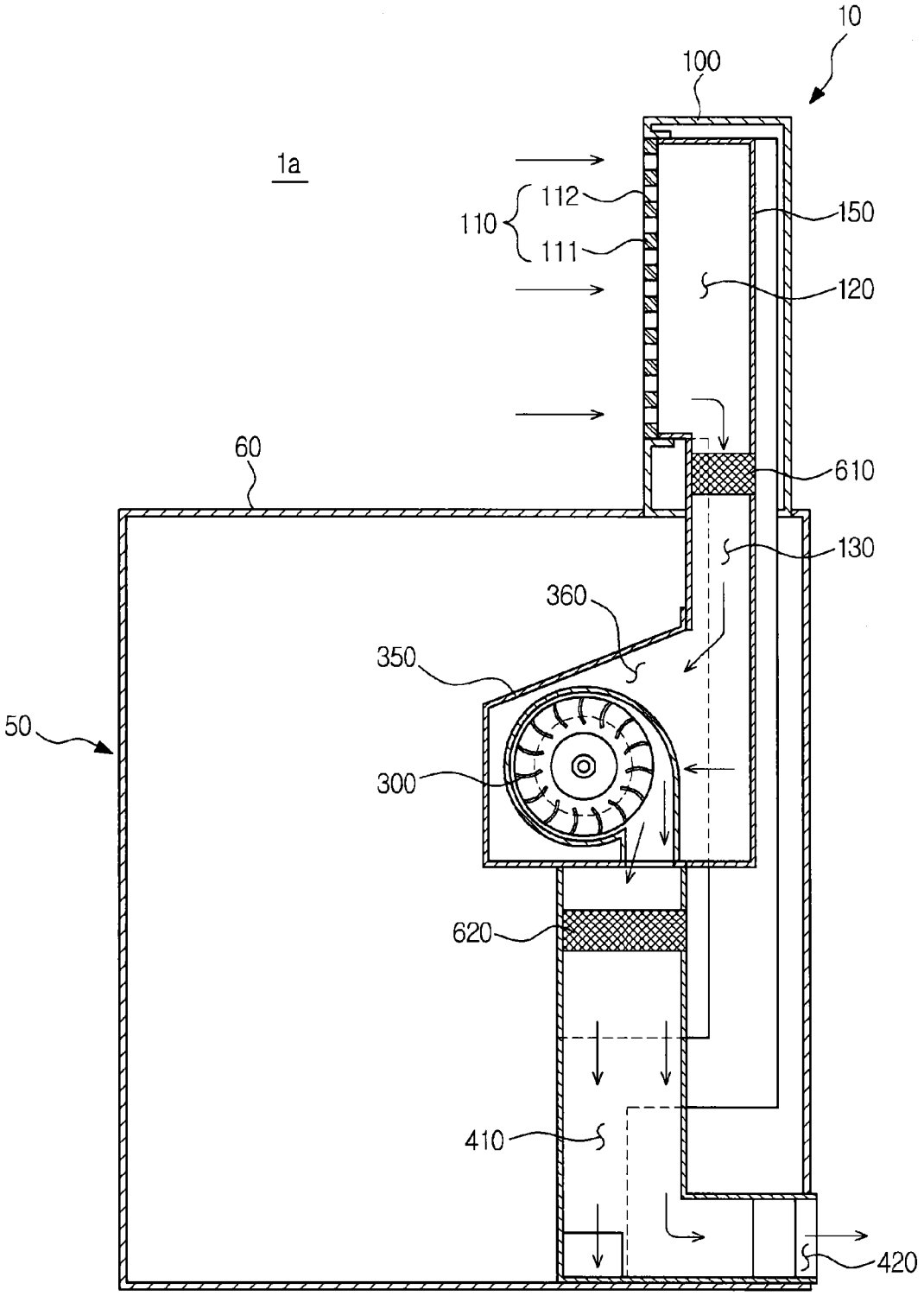
FIG. 6 is a cross-sectional view illustrating the flow of air taken in by the cooking system of FIG. 1.

The suction guide 110 is provided with a guide body 111 and an suction hole 112 formed thereto, and the suction hole 112 is formed while penetrating the guide body 111 such that polluted air is taken in. The polluted air, through the suction hole 112, is introduced to the suction port 120 (FIG. 6).

Each of both side surfaces of the suction port case 150 is provided with a discharging port case 250 disposed thereto. A discharging port 230 is formed inside the discharging port case 250. A front surface of the discharging port 230 is provided with a swirl generating unit (swirl generator) 200 mounted thereto.

The swirl generating unit 200 includes a body 210 and a discharging hole 220 penetratively formed through the body 210. An outer side of a front surface of the ventilation apparatus 10 is provided with a swirl formed thereat, which will be described in detail on FIG. 8.

A lower portion of the suction port case 150 is provided with a fan cover 350 mounted thereto. The fan cover 350 is provided with a fan accommodating unit 360 formed at an inside thereof. An inside the fan accommodating unit 360 is provided with a suction fan 300 disposed therein.

The suction fan 300 is mounted to communicate with the suction port (120 in FIG. 6). Thus, as the suction fan 300 generates suction force, polluted air is taken in to the suction port 120.

An example of a suction fan 300 of an embodiment is a sirocco fan. The sirocco fan is one of the types of centrifugal draft fans, and includes a plurality of blades, each of the plurality of blades having a short length and a wide width while protrudedly formed toward an outer side of a radius direction thereof. The sirocco fan has less noise, and thus is mainly being used as a ventilation fan.

The polluted air is discharged from an inside the fan accommodating unit 360 to a discharging passage 410 by the suction fan 300.

Figure 5:
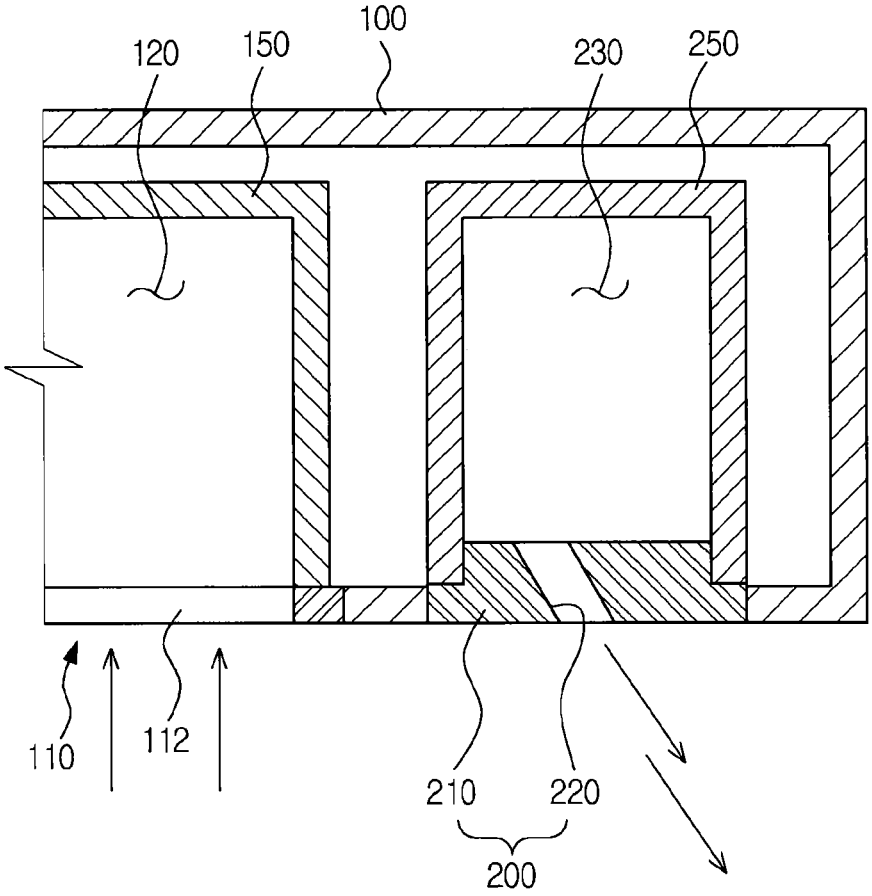
FIG. 5 is a cross-sectional view taken along line 'A-A' of FIG. 4.

FIG. 5 is a cross-sectional view taken along line 'A-A' of FIG. 4.

As illustrated on FIG. 5, the housing 100 is disposed in a way to cover the exterior of the suction port case 150 and the discharging port case 250. The discharging hole 220 of the swirl generating unit 200 mounted at a front surface of the discharging port case 250 is formed in a slanted manner toward an outside of the side surface thereof toward an outside the housing 100. That is, the discharging hole 220 is formed in a way that the air discharged through the discharging port 230 is directed toward an outside of the edge of the upper surface of the body 50.

Thus, the air discharged by the discharging hole 220 is not discharged in a perpendicular direction to the front surface of the ventilation apparatus 10, but is discharged to an outer side of the side surface of the ventilation apparatus 10 while forming a predetermined angle with respect to a front surface of the ventilation apparatus 10.

FIG. 6 is a cross-sectional view illustrating the flow of air taken in by the cooking system of FIG. 1.

As illustrated on FIG. 6, the polluted air containing polluted substance is taken in to the suction port 120 through the suction hole 112 by the suction force of the suction fan 300.

The polluted air taken in to the suction port 120 is introduced to a suction passage 130 connected to a lower side of the suction port 120.

An inside the suction passage 130 is provided with a first filter 610 installed thereto. The first filter 610 may be referred to as a grease filter. The grease filter is configured to collect the oil contained in the polluted air and to liquid-drop the oil that is collected. By eliminating oil substance from the polluted air, the air is purified, and at the same time, the deformation of the duct, which forms a passage of air, as well as the fire by high-temperature oil, is prevented.

The air introduced to the suction passage 130 passes through the first filter 610, and the oil substance therein is eliminated.

An upper side of the suction passage 130 communicates with the suction port 120, and a lower side thereof communicates with the fan accommodating unit 360. Thus, the polluted air passed through the first filter 610 (which may be referred to as the grease filter) of the suction passage 130 is introduced to the fan accommodating unit 360.

The polluted air is introduced to the suction fan 300 from the fan accommodating unit 360, and is discharged to the discharging passage 410, which is connected to a lower side of the fan accommodating unit 360, by the blades of the suction fan 300.

A second filter 620 is installed inside of the discharging passage 410. The second filter 620 may be configured to eliminate Volatile Organic Compounds (VOCs).

The VOCs are referred to as the hydrocarbon substance that generates odor or ozone as volatized into air. In particular, the VOCs are directly harmful to the environment and humans, and furthermore, participate in a photochemical reaction in air to generate a secondary pollutant such as photochemical oxidation substance.

The VOCs, as one of the substances causing cancer, need to be eliminated when the polluted air is discharged indoors. Thus, the polluted air is purified by the second filter 620 to clean air so that VOCs are eliminated from the polluted air.

The air having pollutants therein eliminated therefrom is in a suitable state to be discharged indoors.

Thus, a portion of the air passed through the second filter 620 at an inside the discharging passage 410 is discharged to an outside the case through the exit port 420. The outside of the case is referred to as the indoor at where the cooking system 1*a* is positioned.

As the polluted air is purified at an inside the cooking system 1*a* and discharged directly indoors, a duct is not needed to be connected to outside a building such as a home.

Some of the air that is purified by the second filter 620, which is not discharged through the exit port 420, is introduced to a split passage 430.

Figure 7:
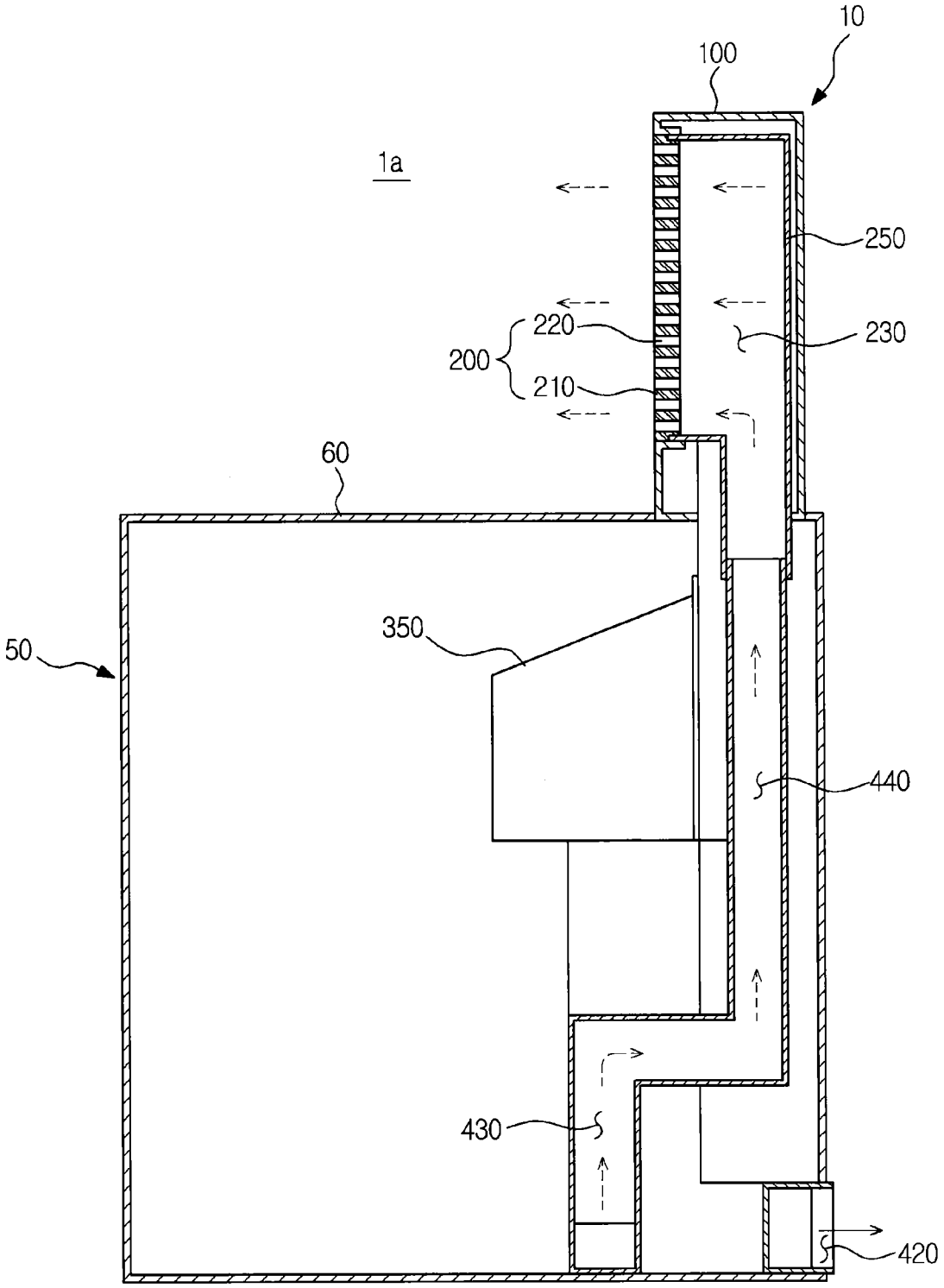
FIG. 7 is a cross-sectional view showing the flow of air discharged by the cooking system of FIG. 1.

FIG. 7 is a cross-sectional view showing the flow of air discharged by the cooking system of FIG. 1.

As illustrated on FIG. 7, the split passage 430 is a passage disposed in between the discharging passage 410 and an ascending passage 440, and configured for the discharging passage 410 to communicate with the ascending passage 440. Thus, the air introduced to the split passage 430 is introduced to the ascending passage 440 through the split passage 430.

A lower portion of the ascending passage 440 is connected to the split passage 430, and an upper portion of the ascending passage 440 is connected to the discharging port 230. Thus, air is ascended along the ascending passage 440, and flows to the discharging port 230.

The air moved to the discharging port 230 is discharged to a front of the ventilation apparatus 10 through the discharging hole 220 of the swirl generating unit 200, and generates a swirl.

The generation of the swirl will be described in detail on FIG. 8.

By using the passage structure, without having to use a separate driving apparatus, a swirl can be generated. However, the present disclosure is not limited thereto, and may include generating a swirl by discharging air to the discharging hole 220 of the swirl generating unit 200 by use of a separate driving apparatus.

Figure 8:
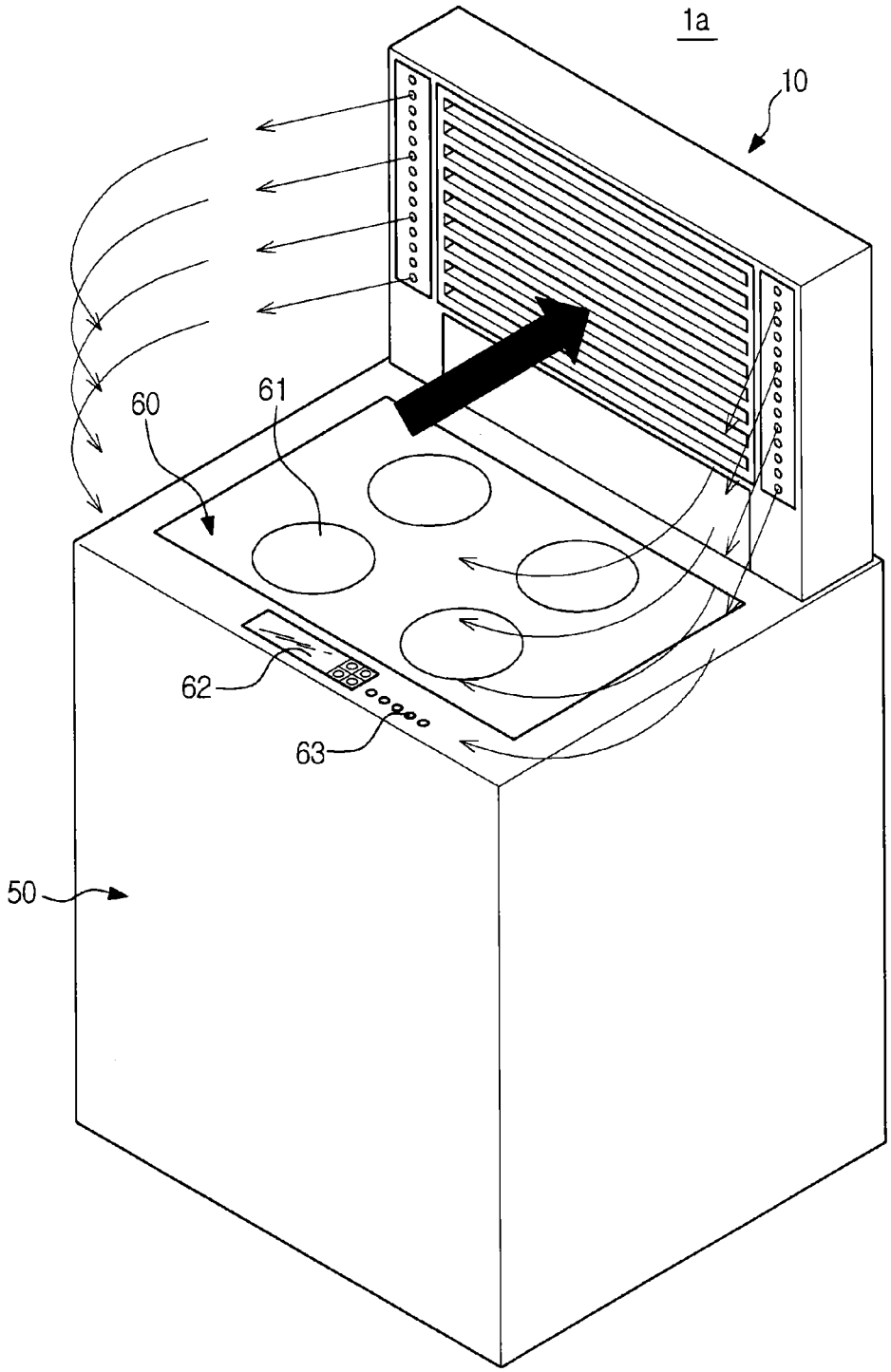
FIG. 8 is a drawing showing the flow of outside air generated by a swirl formed by the cooking system of FIG. 1.

FIG. 8 is a drawing showing the flow of outside air generated by a swirl formed by the cooking system of FIG. 1.

As illustrated on FIG. 8, by the discharging hole 220 of the swirl generating unit 200, air is discharged further toward outside of the edges of the right side and left side of the upper surface of the body 50. At the same time, by the suction fan 300 (FIG. 3), the polluted air is taken in to the suction guide 110. According to the structure, a front side portion of the suction guide 110 is provided with a low air density.

Thus, the air discharged from the discharging hole 220 of the swirl generating unit 200 to an outside direction of the housing 100 is circulated toward the central portion of an upper surface of the body 50. As the air is circulated, a swirl is generated. Furthermore, the air flows toward a direction of the central portion of an upper surface of the body 50 by the suction force of the suction fan 300, and a swirl is generated by such.

As a swirl is generated, without increasing the capacity of the suction fan 300, the polluted air that is generated from a farther portion from the suction guide 110 may be taken in. In addition, the polluted air that is generated from a closer portion from the suction guide 110 is drawn with an enhanced suction efficiency.

In addition, the swirl forms an air curtain, and the air curtain may reduce the polluted air, which is generated from the cooking unit 60, from being dispersed and spread into indoors.

Figure 9:
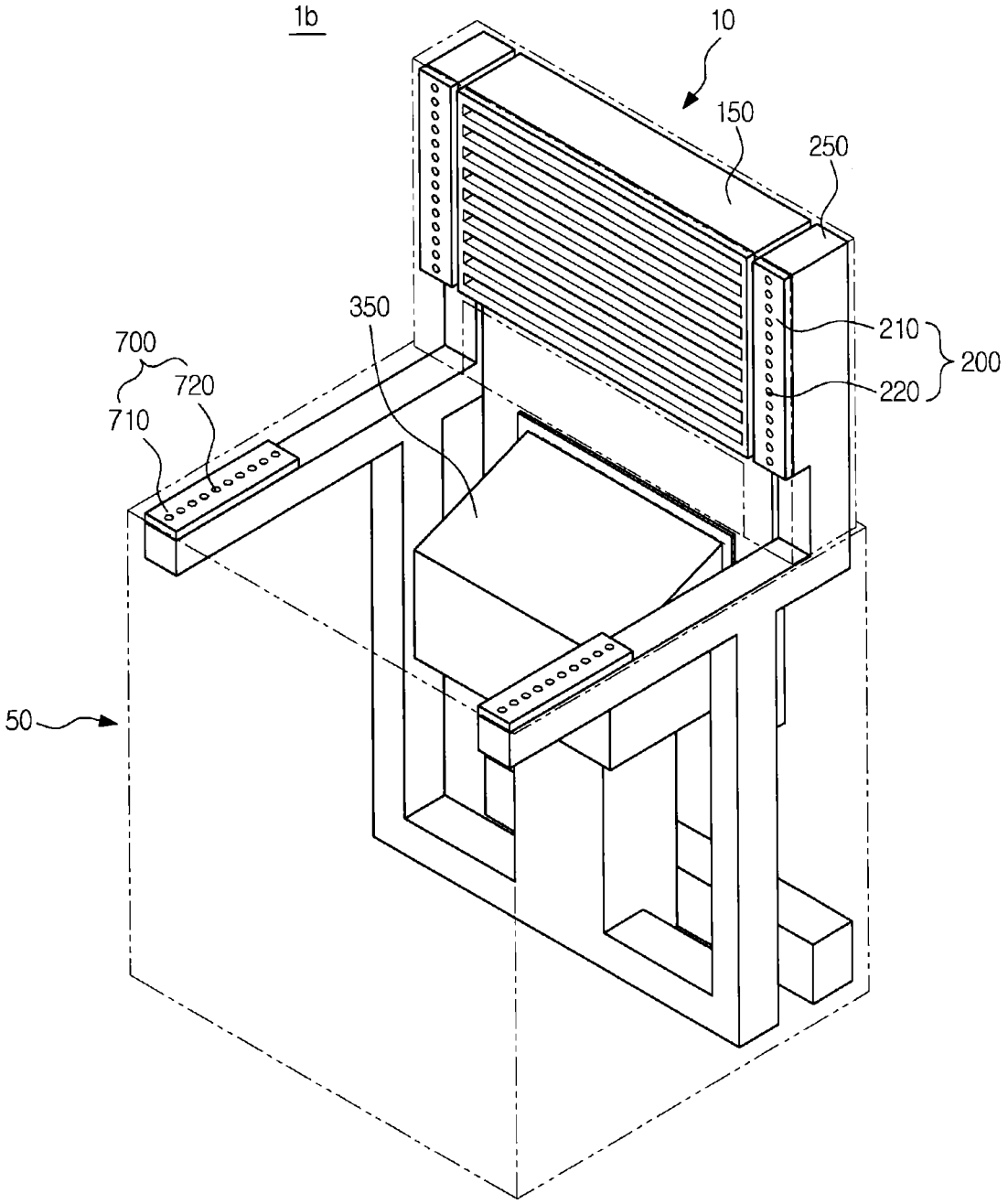
FIG. 9 is a drawing illustrating an inside structure of a body of a cooking system in accordance with an embodiment.
Figure 10:
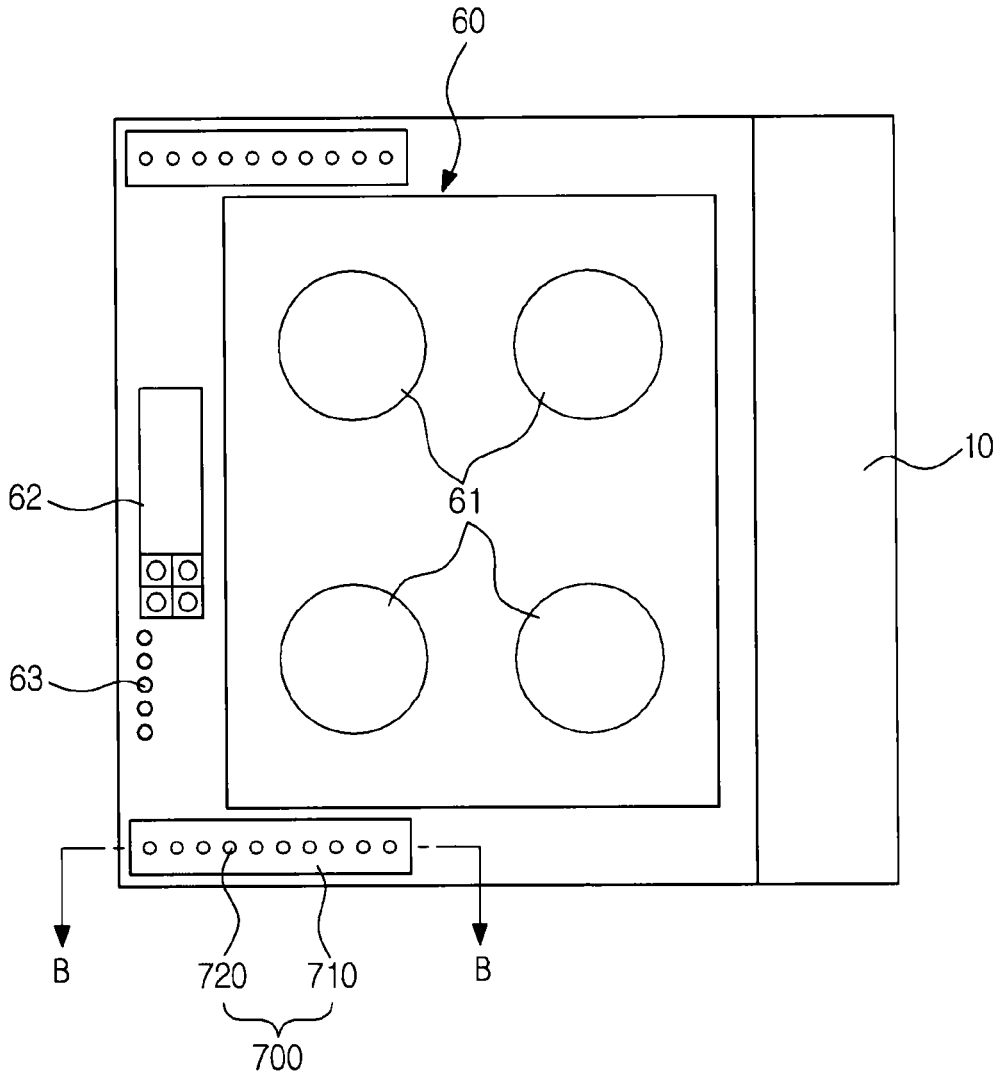
FIG. 10 is a drawing illustrating a cooking part of the cooking system of FIG. 9.

FIG. 9 is a drawing illustrating an inside structure of a body of a cooking system in accordance with a second embodiment of the present disclosure. FIG. 10 is a drawing illustrating a cooking part of the cooking system of FIG. 9.

As illustrated on FIGS. 9 and 10, a cooking system 1*b* includes the body 50 forming the exterior of the cooking system 1*b*, the cooking unit 60 formed at an upper surface of the body 50, and the ventilation apparatus 10 mounted at an edge of an upper surface of the body 50.

The cooking unit 60 includes the heating apparatus 61 to apply heat on foods, the manipulation unit 63 to control the heating apparatus 61, and the display unit 62 to display the state and operation of the heating apparatus 61.

The ventilation apparatus 10 includes the housing 100 forming an exterior of the ventilation apparatus 10, a plurality of passages formed by a plurality of ducts, the suction guide 110 disposed at a front of the housing 100, the swirl generating unit 200 to discharge air, and a suction reinforcing unit 700 to increase the amount of the air taken in to the suction guide 110.

The housing 100 forms an exterior of the ventilation apparatus 10, and configured to accommodate other components of the ventilation apparatus 100.

The suction port case 150 is disposed inside the housing 100 to form the suction port 120, and a front surface of the suction port case 150 is provided with the suction guide 110 mounted thereto.

The suction guide 110 is provided with the guide body 111 and the suction hole 112 formed thereto, and the suction hole 112 is formed while penetrating the guide body 111 such that polluted air is taken in.

Each of both side surfaces of the suction port case 150 is provided with the discharging port case 250 disposed thereto. An inside the discharging port case 250 is provided with a first discharging port 230 formed therein. A front surface of the first discharging port 230 is provided with the swirl generating unit 200 mounted thereto. The swirl generating unit 200 includes the body 210 and the first discharging hole 220 penetratively formed through the body 210.

Since the shape of the first discharging hole 220 has the same shape as the discharging hole 220 illustrated on FIG. 5, a detailed description thereof will be omitted.

The suction reinforcing unit 700 is mounted on the left and right sides of the cooking unit 60 on the upper surface of the body 50. The suction reinforcing unit 700 includes a plate 710 and a second discharging hole 720 penetratively formed through the plate 710.

Figure 11:
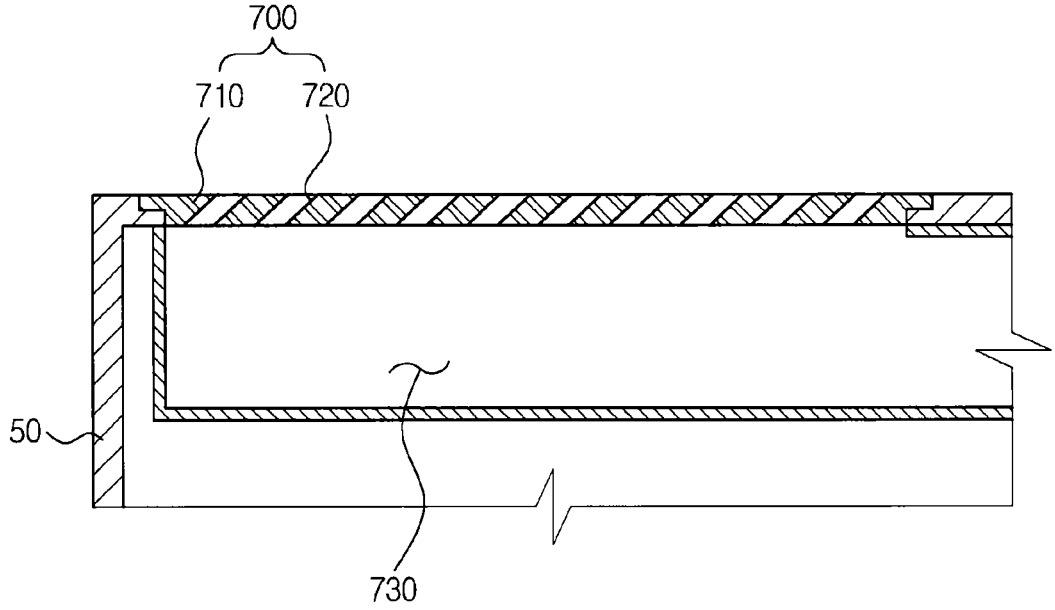
FIG. 11 is a cross-sectional view taken along line 'B-B' of FIG. 10.

FIG. 11 is a cross-sectional view taken along line 'B-B' of FIG. 10.

As illustrated on FIG. 11, as the second discharging hole 720 is headed further toward an outside from an inside the body 50, the second discharging hole 720 is formed in a slanted manner toward a rear thereof, that is, toward the suction guide 110. Thus, the air discharged by the second discharging hole 720 is not directed in a perpendicular direction to the front surface of the body 50. Instead, the air discharged by the second discharging hole 720 is directed to the suction guide 110.

Figure 12:
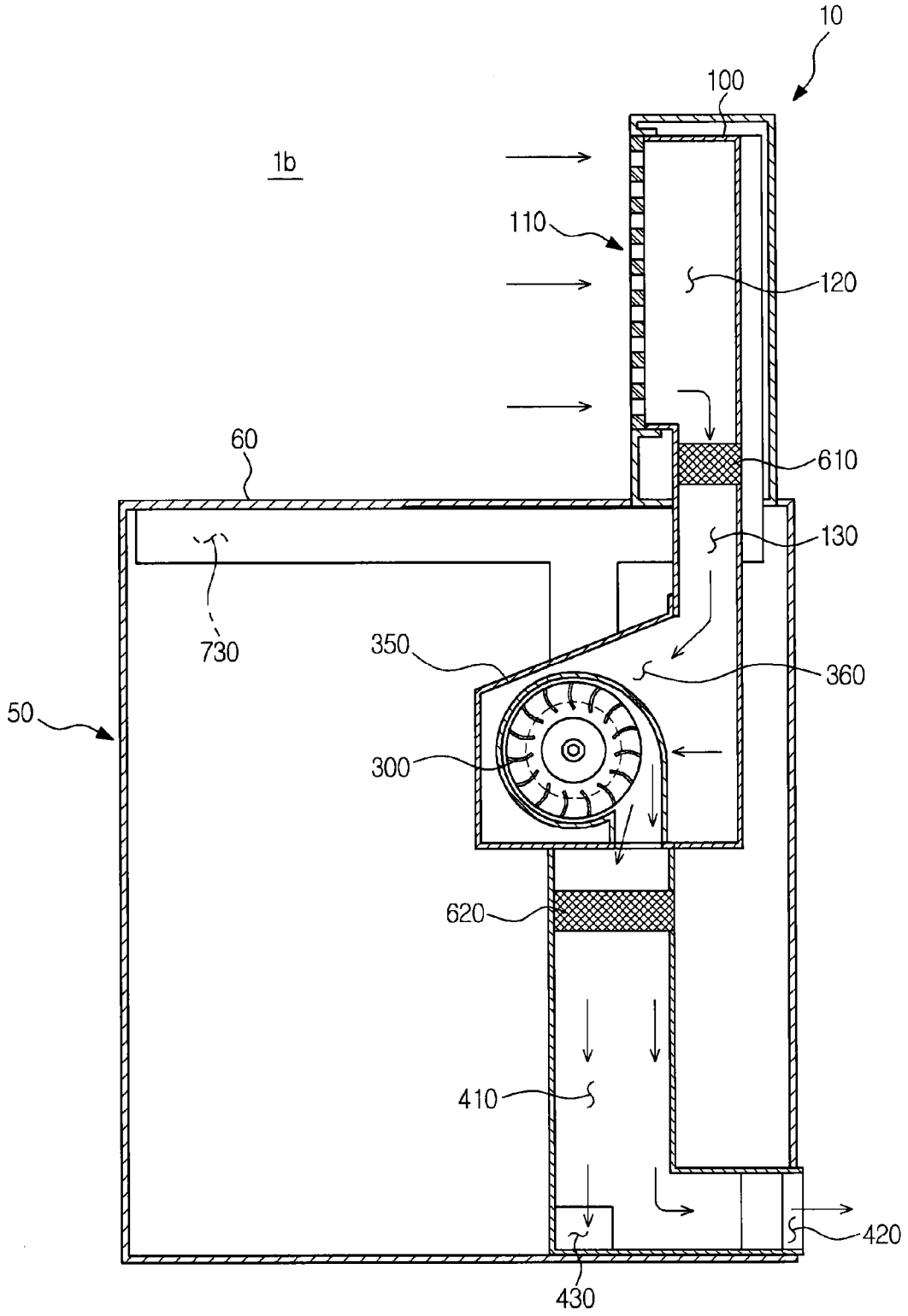
FIG. 12 is a cross-sectional view illustrating the flow of air taken in by the cooking system of FIG. 9.

FIG. 12 is a cross-sectional view illustrating the flow of air taken in by the cooking system of FIG. 9.

As illustrated on FIG. 12, the polluted air containing polluted substance is taken in to the suction port 120 through the suction hole 112 of the suction guide 110 by the suction force of the suction fan 300.

The polluted air taken in to the suction port 120 is introduced to the suction passage 130 connected to a lower side of the suction port 120.

An inner side of the suction passage 130 is provided a first filter 610 installed thereto. The first filter 610 may be a grease filter, which serves to remove oil included in the pullulated air. An upper side of the suction passage 130 communicates with the suction port 120, and a lower side of the suction passage 130 communicates with the fan accommodating unit 360. Thus, the polluted air, passed through the first filter 610 (which may be a grease filter) of the suction low path 130, is introduced to the fan accommodating unit 360.

The polluted air is introduced to the suction fan 300 from the fan accommodating unit 360, and is discharged to the discharging passage 410, which is connected to a lower side of the fan accommodating unit 360, by the blades of the suction fan 300.

The second filter 620 may be installed inside of the discharging passageway 410. By the second filter 620, the Volatile Organic Compounds (VOCs) in the polluted air are eliminated.

The air having pollutants filtered therefrom is in a suitable state to be discharged indoors, and a portion of the air is discharged to outside the case, that is, indoors, through the exit port 420.

The air that is not discharged through the exit port 420 is introduced to the split passage 430.

Figure 13:
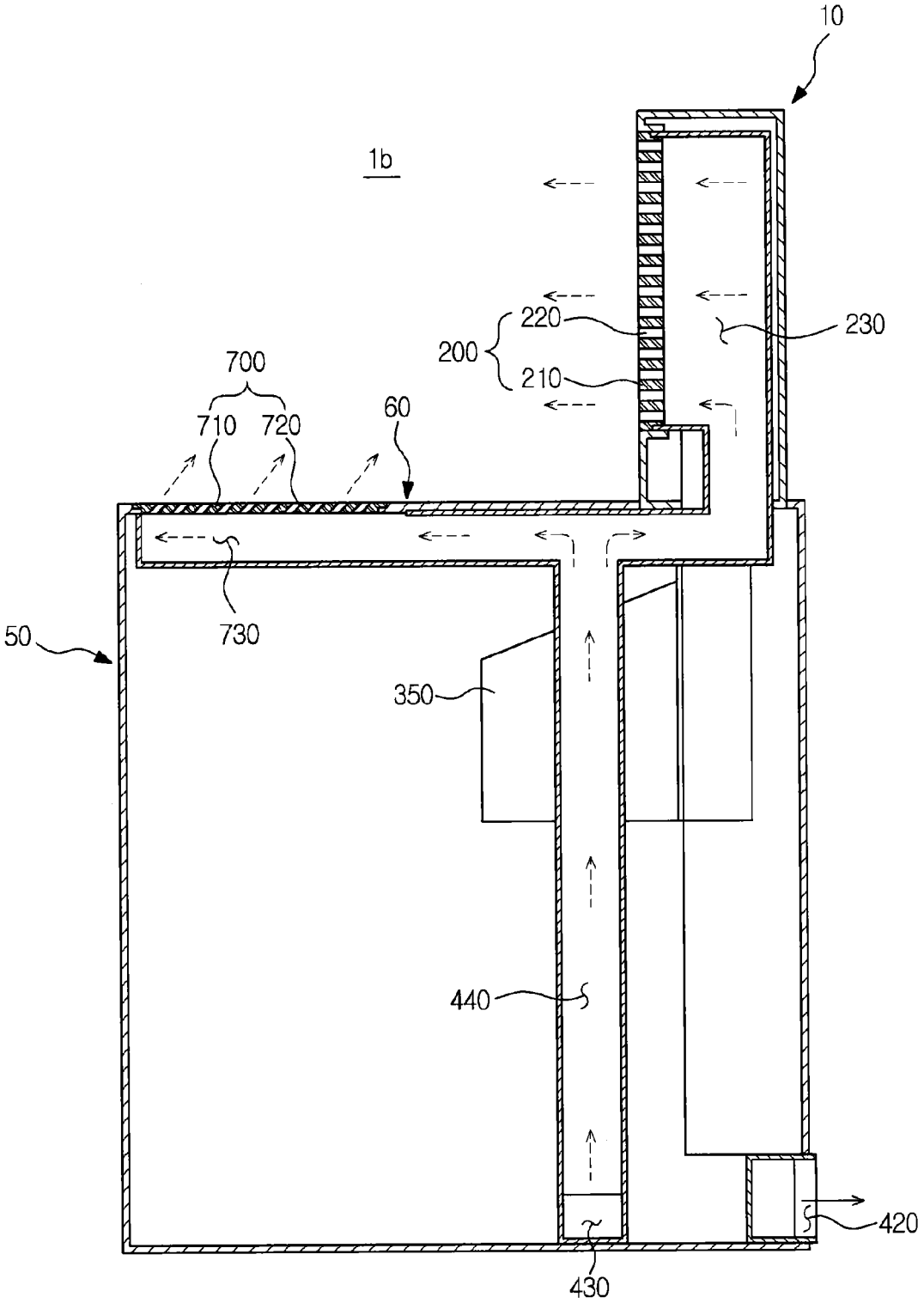
FIG. 13 is a cross-sectional view showing the flow of air discharged by the cooking system on FIG. 9.

FIG. 13 is a cross-sectional view showing the flow of air discharged by the cooking system on FIG. 9.

As illustrated on FIG. 13, the air introduced to the split passage 430 is introduced to the ascending passage 440 through the split passage 430.

A lower portion of the ascending passage 440 is connected to the split passage 430, and an upper portion of the ascending passage 440 becomes a junction at where the first discharging port 230 and the second discharging port 730 are split. Thus, a portion of the air entered into the ascending passage 440 is introduced to the first discharging port 230, while a remaining portion thereof is introduced to the second discharging port 730.

The air introduced to the first discharging port 230 is discharged to a front of the ventilation apparatus 10 through the first discharging hole 220 of the swirl generating unit 200, and generates a swirl.

The air introduced to the second discharging port 730 is discharged toward the suction guide 110 through the second discharging hole 720 of the suction reinforcing unit 700.

As previously researched, without having to use a separate driving apparatus, a swirl can be generated. Furthermore, without a driving apparatus, the suction of the polluted air can be made stronger. However, the discharging of air by a driving apparatus while mounted at the swirl generating unit 200 or the suction reinforcing unit 700 may be included in the aspect of the present disclosure.

Figure 14:
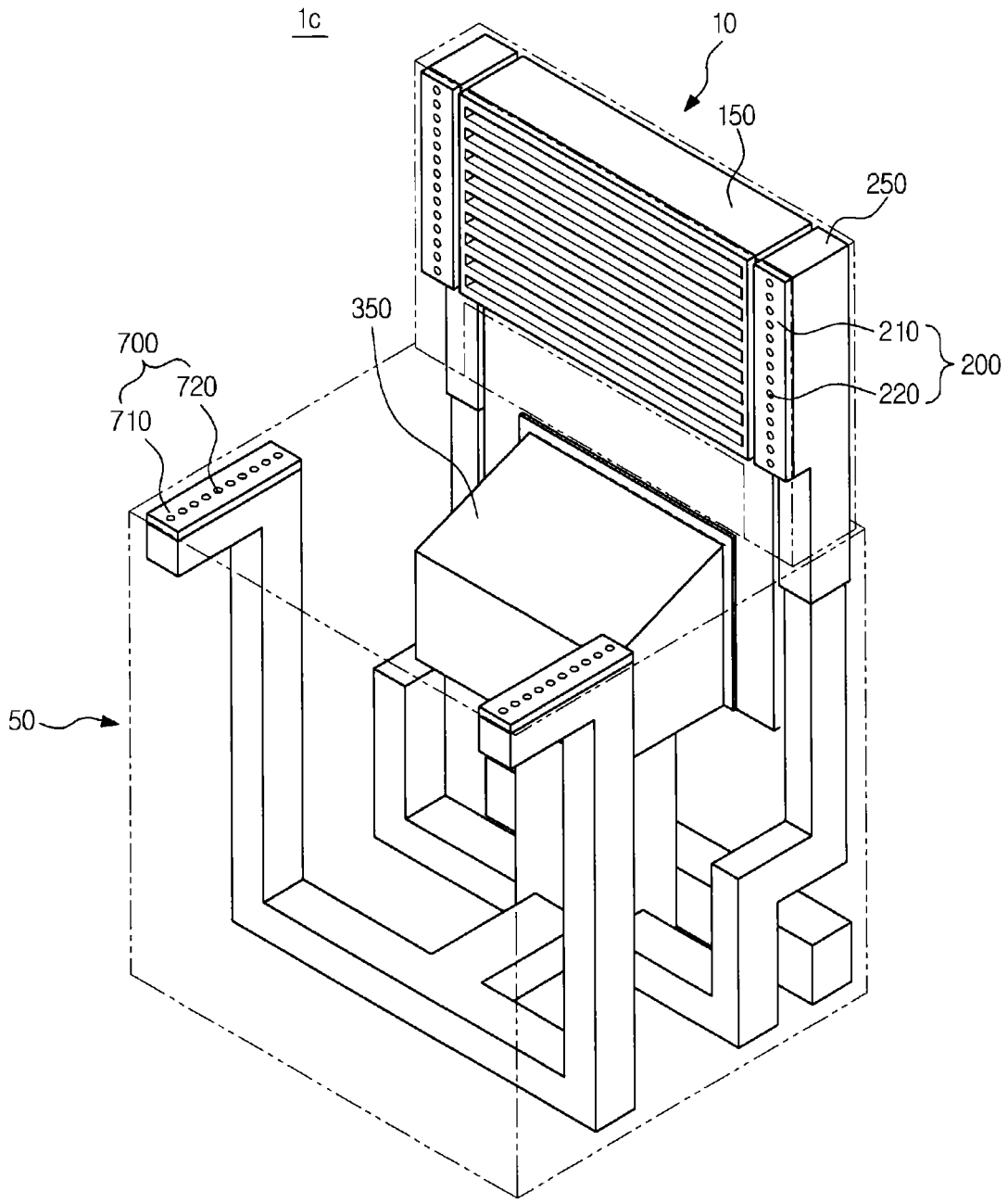
FIG. 14 is a drawing showing the flow of outside air generated by a swirl formed by the cooking system of FIG. 9.

FIG. 14 is a drawing showing the flow of outside air generated by a swirl formed by the cooking system of FIG. 9.

As illustrated on FIG. 14, the air discharged through the first discharging hole 220 of the swirl generating unit 200 is headed toward the right side and left side of the body 50, not toward the direction of the cooking unit 60. At the same time, by the suction fan 300 (FIG. 12), the polluted air is taken in to the suction guide 110. Thus, a front side portion of the suction guide 110 has a low air density, and thereby the air discharged through the first discharging hole 220 is circulated toward the central portion of the cooking unit 60. As the air is spiraled, a swirl is formed.

The air discharged from the second discharging hole 720 of the suction reinforcing unit 700 accelerates the flow of the air that is spiraled while circulating. At the same time, the air discharged from the second discharging hole 720 enforces the flow of the air headed toward the suction guide 110 and thus increases the amount of the air taken in to the suction port 120.

That is, without having to increase the capacity of the suction fan 300, the suction efficiency can be further enhanced.

Figure 15:
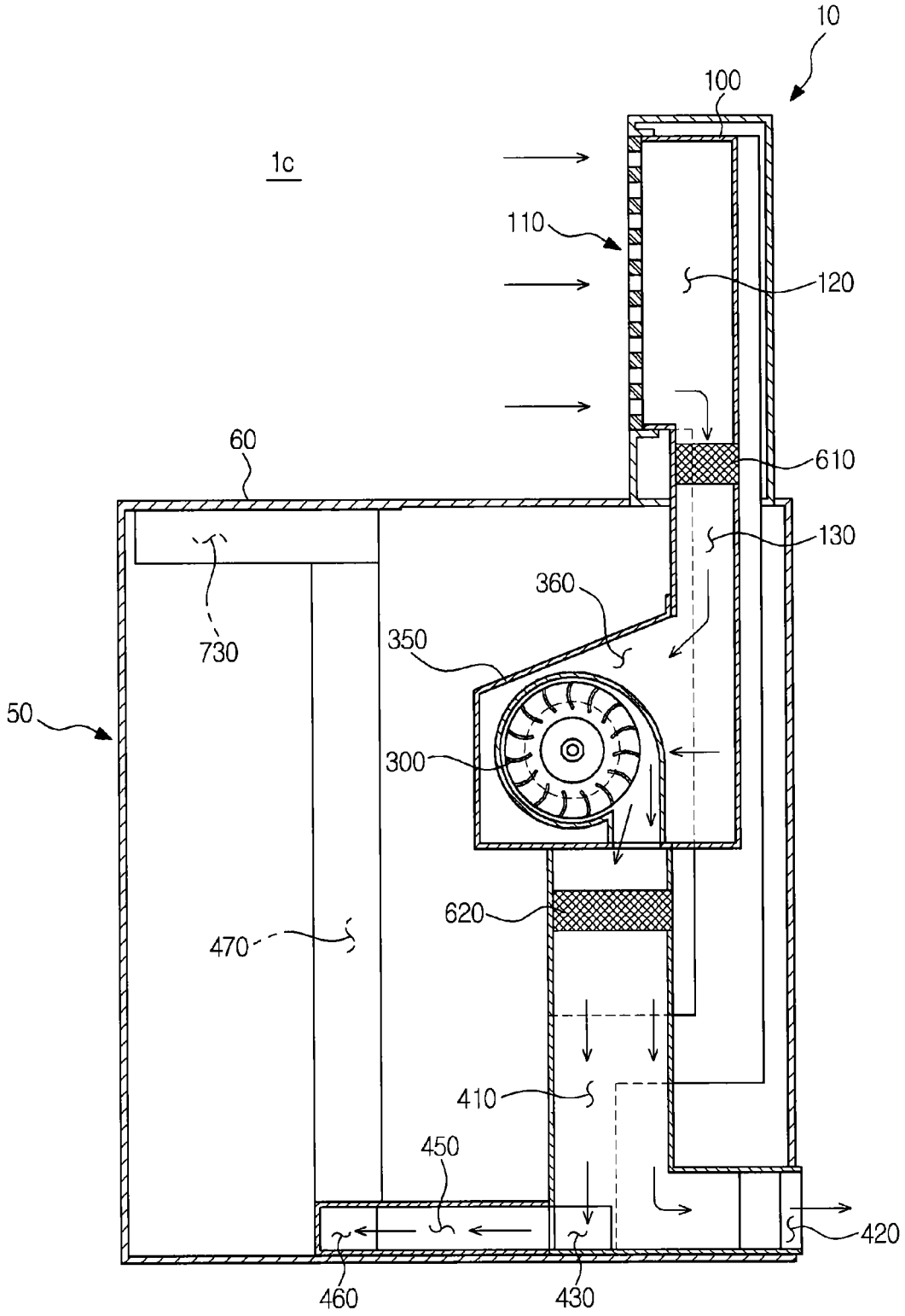
FIG. 15 is a drawing illustrating an inside structure of a body of a cooking system in accordance with an embodiment.

FIG. 15 is a drawing illustrating an inside structure of a body of a cooking system in accordance with a third embodiment of the present disclosure.

As illustrated on FIG. 15, a passage of the cooking system in accordance with the third embodiment of the present disclosure is different in the structure from that of the cooking system in accordance with the second embodiment of the present disclosure.

The passage and the flow of the air passing through the passage will be mainly described on the drawings hereinafter.

Figure 16:
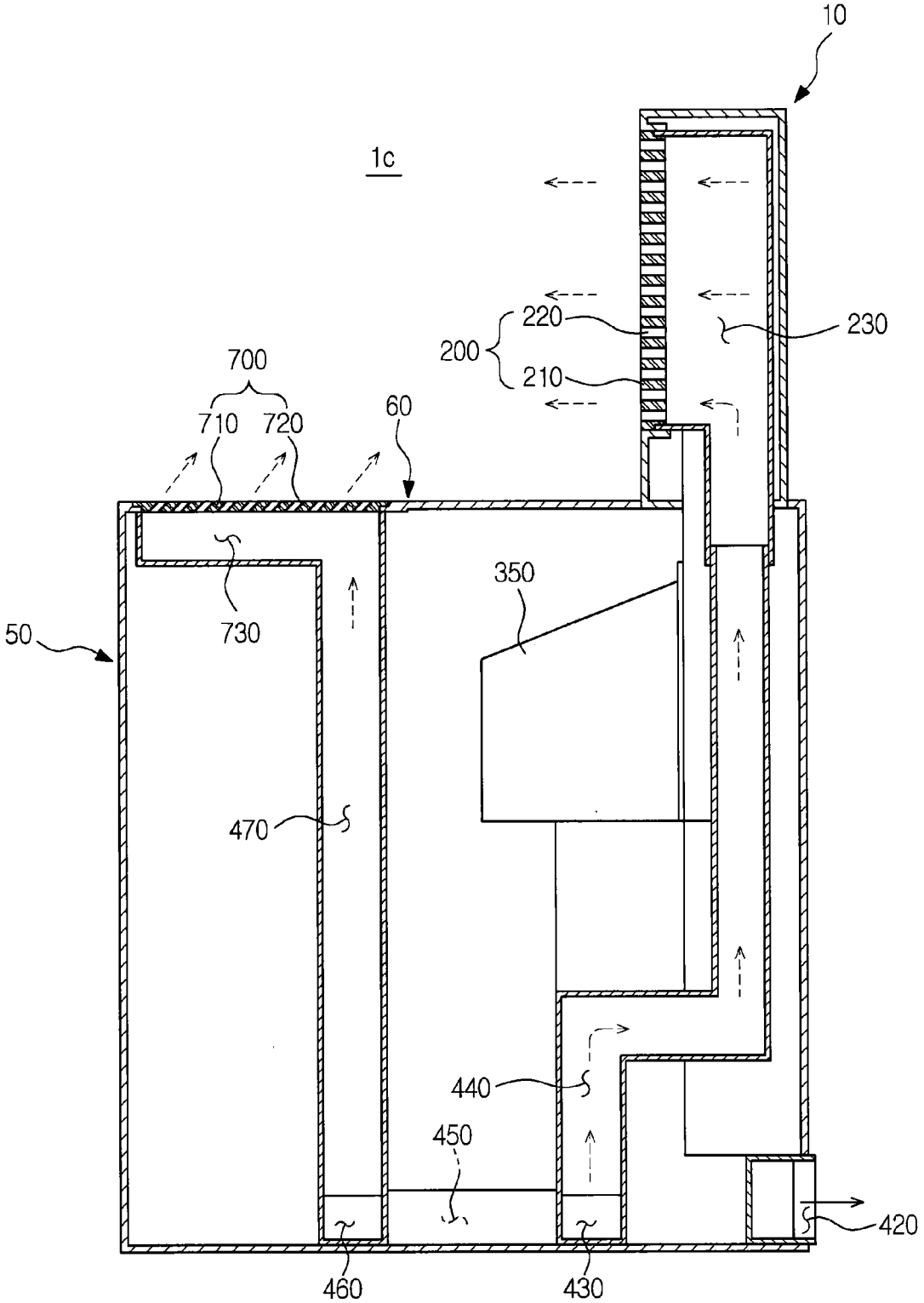
FIG. 16 is a cross-sectional view illustrating the flow of air taken in by the cooking system of FIG. 15.

FIG. 16 is a cross-sectional view illustrating the flow of air taken in by the cooking system of FIG. 15.

As illustrated on FIG. 16, the polluted air containing polluted substance is taken in to the suction port 120 through the suction hole 112 of the suction guide 110 by the suction force of the suction fan 300.

The polluted air taken in to the suction port 120 is introduced to the suction passage 130 connected to a lower side of the suction port 120.

A first filter 610 may be installed inside the suction passage 13. The first filter 610 may be a grease filter, which eliminates the oil contained in the polluted air.

An upper side of the suction passage 130 communicates with the suction port 120, and a lower side of the suction passage 130 communicates with the fan accommodating unit 360. Thus, the polluted air passed through the grease filter of the suction passage 130 is introduced to the fan accommodating unit 360.

The polluted air is introduced to the suction fan 300 from the fan accommodating unit 360, and is discharged through the discharging passage 410, which is connected to a lower side of the fan accommodating unit 360, by the blades of the suction fan 300.

An inside the discharging passage 410 is provided with the second filter 620 installed therein. By the second filter 620, the Volatile Organic Compounds (VOCs) in the polluted air is eliminated.

The air having pollutants filtered therefrom is in a suitable state to be discharged to an indoor, and a portion of the air is discharged to an outside the case, that is, an indoor, through the exit port 420.

A portion of the air that is not discharged through the exit port 420 is introduced to the first split passage 430, and a remaining of the air thereof is introduced to a connecting passage 450.

Figure 17:
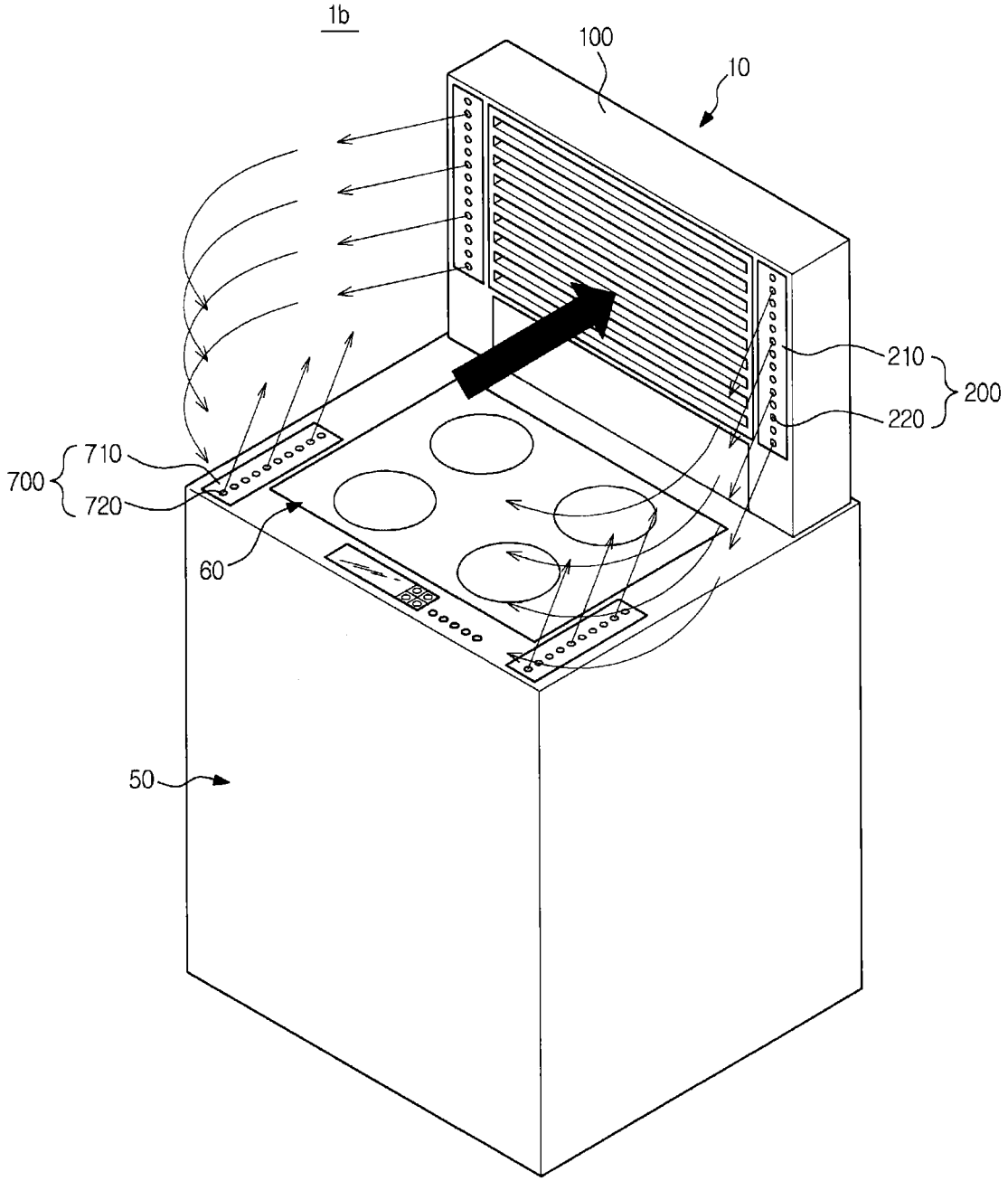
FIG. 17 is a cross-sectional view showing the flow of air discharged by the cooking system of FIG. 15.

FIG. 17 is a cross-sectional view showing the flow of air discharged by the cooking system of FIG. 15.

As illustrated on FIG. 17, the first split passage 430 is a passage disposed in between the discharging passage 410 and the first ascending passage 440, and configured for the discharging passage 410 to communicate with the first ascending passage 440. Thus, the air introduced to the first split passage 430 is introduced to the first ascending passage 440 through the first split passage 430.

A lower portion of the first ascending passage 440 is connected to the first split passage 430, and an upper portion of the first ascending passage 440 is connected to the first discharging port 230. Thus, air is ascended along the first ascending passage 440, and flows to the first discharging port 230.

The air moved to the first discharging port 230 is discharged to a front of the ventilation apparatus 10 through the first discharging hole 220 of the swirl generating unit 200, and generates a swirl.

The connecting passage 450 is provided with an end portion thereof connected to a second split passage 460, and the second split passage 460 is connected to second ascending passages 470 provided in two units.

Thus, the air introduced to the connecting passage 450 is ascended along the second ascending passage 470 through the second split passage 460. An upper portion of the second ascending passage 470 is connected to the second discharging port 730. Thus, the air at the second ascending passage 470 is discharged toward the suction guide 110 by sequentially passing through the second discharging port 730 and the second discharging hole 720 of the suction reinforcing unit 700.

The description of the swirl formed by the air discharged from the first discharging port 230 and the flow of the air discharged from the second discharging port 730 are omitted while assumed to be the same as that described with reference to FIG. 14.

Figure 18:
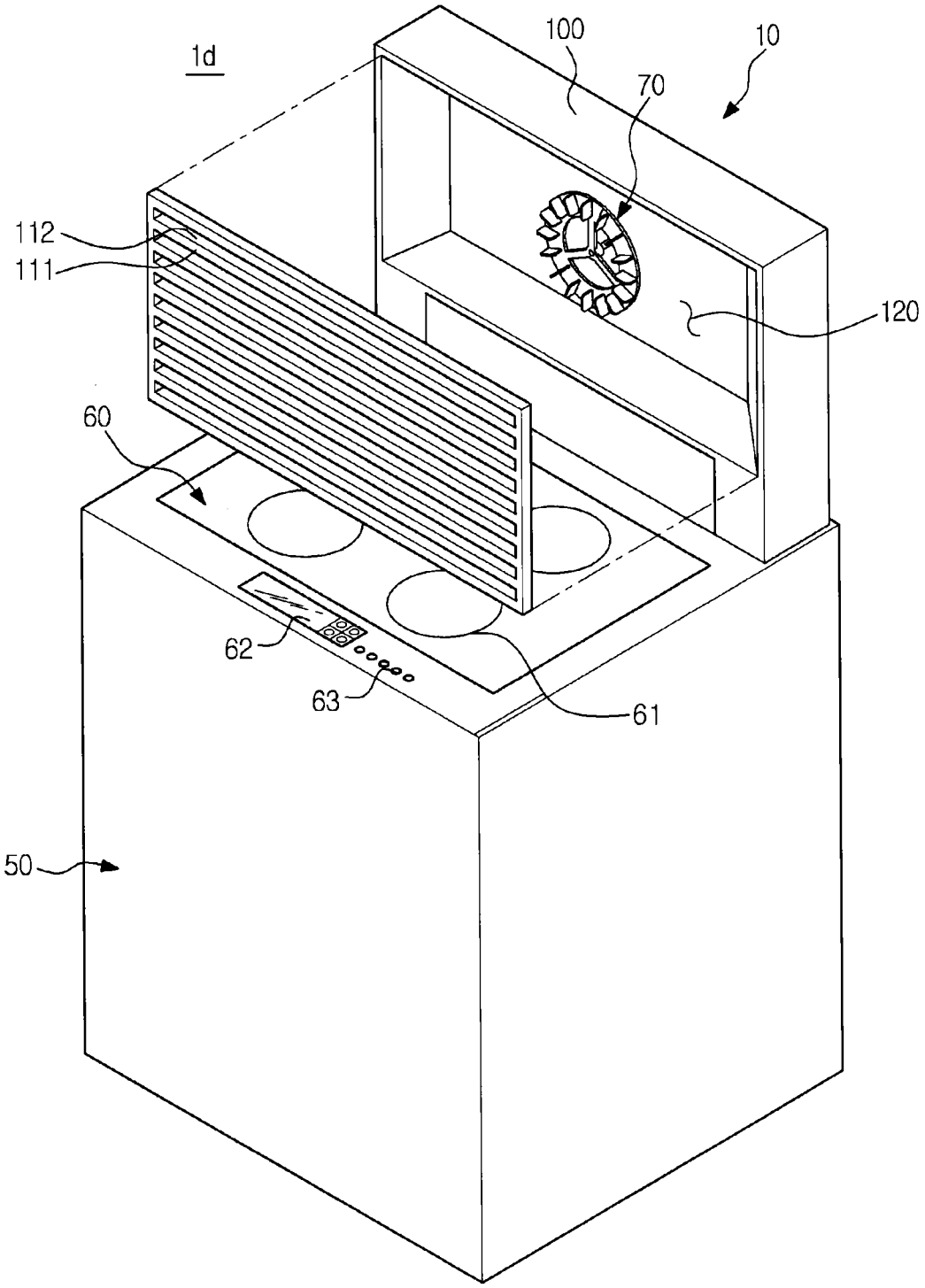
FIG. 18 is a drawing illustrating a structure of a cooking system in accordance with an embodiment.

FIG. 18 is a drawing illustrating a structure of a cooking system in accordance with a fourth embodiment of the present disclosure.

As illustrated on FIG. 18, a cooking system 1*d* includes the body 50 forming an exterior of the cooking system 1*d*, the cooking unit 60 formed at an upper surface of the body 50, and the ventilation apparatus 10 mounted at an edge of the upper surface of the body 50.

The cooking unit 60 includes the heating apparatus 61 to apply heat directly on foods, the manipulation unit 63 to control the heating apparatus 61, and the display unit 62 to display the state and operation of the heating apparatus 61.

The ventilation apparatus 10 includes the housing 100 forming an exterior of the ventilation apparatus 10 and configured to accommodate each component of the ventilation apparatus 10, the suction guide 100 disposed at a front of the housing 100, and a swirler fan 70 to discharge a portion of the air that is taken in so that a swirl is generated.

The ventilation apparatus 10 is protrudedly provided from an upper surface of the body 50 toward an upper direction thereof, and is disposed at a side adjacent to an edge of the upper surface of the body 50.

The housing 100 forms the exterior of the ventilation apparatus 10, and at the same time, forms the suction port 120 at an inside therein.

A front surface of the suction port 120 is provided with a suction guide 110 mounted thereto to cover the suction port 120. The suction guide 110 is provided with the guide body 111 and the suction hole 112 formed thereto, and the suction hole 112 is formed while penetrating the guide body 111 such that polluted air is taken in.

Figure 19:
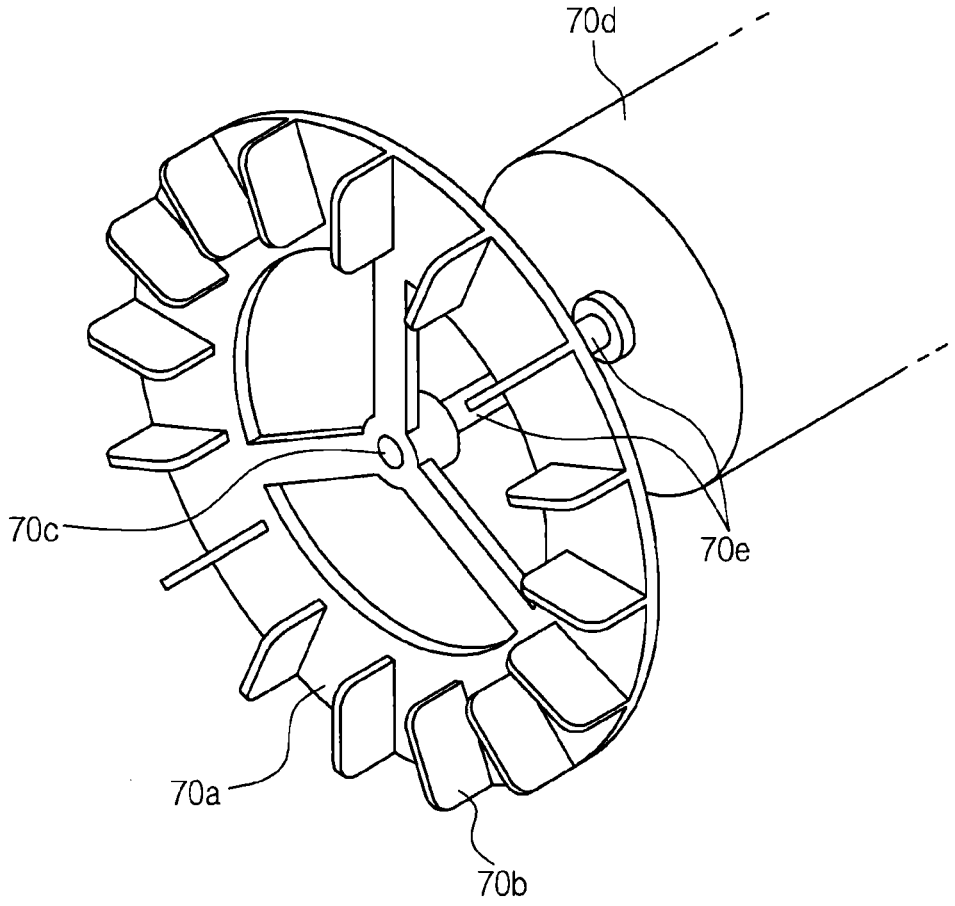
FIG. 19 is a drawing illustrating a swirler fan of FIG. 18.

FIG. 19 is a drawing illustrating a swirler fan of FIG. 18.

As illustrated on FIG. 19, the swirler fan 70 includes a rotating plate 70*a* to rotating on a rotating axis 70*c*, and a plurality of blades 70*b* arranged on the rotating plate 70*a* along the circumferential direction of the rotating plate 70*a*. The blades 70*b* are protrudedly formed in a perpendicular direction to the surface of the rotating plate 70*a*. In addition, the blades 70*b* are provided with one end thereof facing the rotating axis 70*c*, while the other end thereof facing an outer side of the radius direction of the swirler fan 70.

A rear of the swirler fan 70 is provided with a driving unit 70*d* disposed thereto to generate a driving force for the rotation of the swirler fan 70, and the driving unit 70*d* is connected to the rotating axis 70*c* of the rotating plate 70*a* through a shaft 70*e*. The driving force of the driving unit 70*d* is delivered to the rotating plate 70*a* through the shaft 70*e*.

As the swirler fan 70 having the structure as the drawing is rotated, air is discharged toward an outer side of the radius direction of the rotating plate 70*a*. Thus, the air is discharged through both side portions of the suction guide 110. Further, the air is discharged in a slanted manner toward an outer side of the both sides of the body 50.

Figure 20:
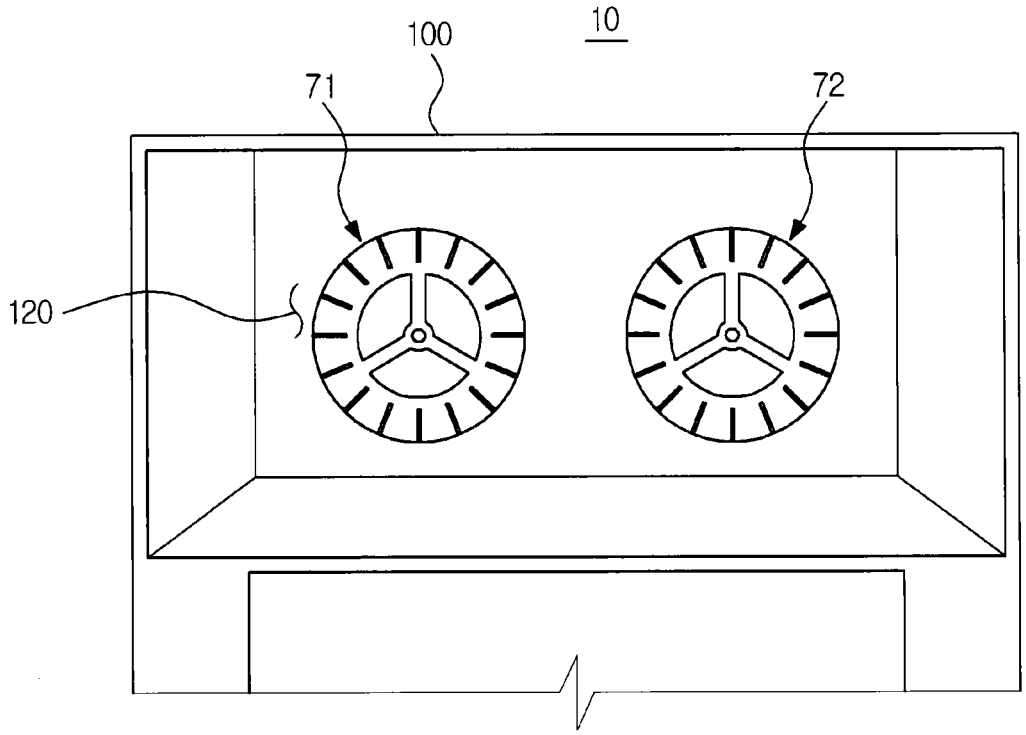
FIG. 20 is a drawing illustrating a ventilation apparatus of the cooking system of FIG. 19 according to an embodiment.

FIG. 20 is a drawing illustrating a ventilation apparatus of the cooking system of FIG. 19 according to another embodiment of the present disclosure.

As illustrated on FIG. 20, two swirler fans 71 and 72 are mounted at the ventilation apparatus 10.

The swirler fan, due to the shape thereof, is provided with different amount of the air discharged, depending on the direction of the air being discharged. Thus, in a case when the swirler fan is provided in a single unit, more of air is discharged toward one of the left side and the right side of the suction guide 110, and accordingly, a swirl having larger size is generated at one side of the suction guide 110. Thus, the amount of the polluted air that is taken in may be different between the left side and the right side of the suction guide 110.

In an embodiment, the swirler fans 71 and 72 are mounted, and the amount of the air discharged to the left and right side of the suction guide 110 is balanced.

By opposing the directions of the blades 70*b* of the swirler fans 71 and 72, or by reversing the rotating directions of the swirler fans 71 and 72, the amount of the air being discharged from both sides may be balanced.

Figure 21:
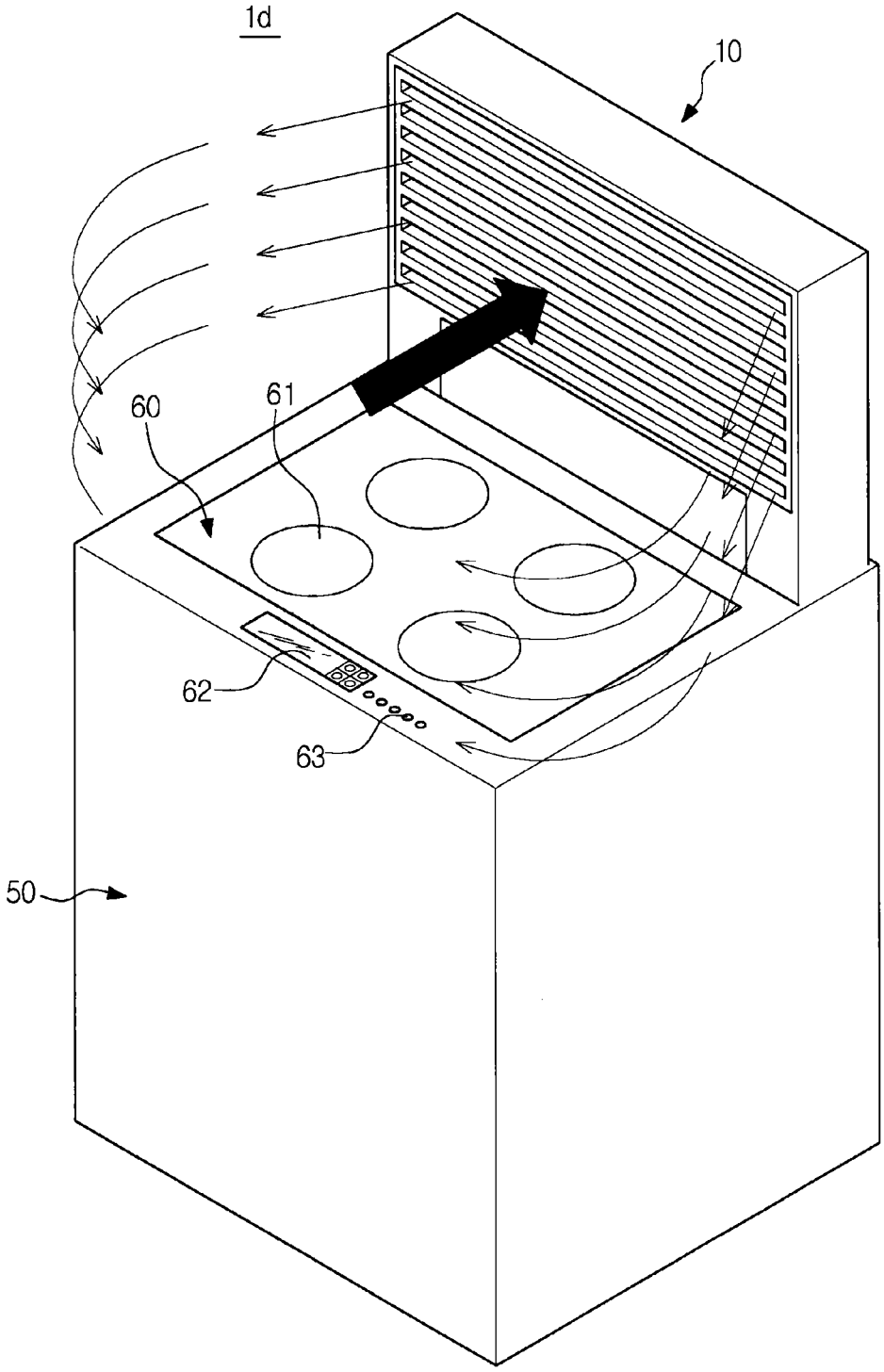
FIG. 21 is a drawing showing the flow of outside air generated by a swirl formed by the cooking system on FIG. 18.

FIG. 21 is a drawing showing the flow of outside air generated by a swirl formed by the cooking system on FIG. 18.

As illustrated on FIG. 21, by the swirler fan 70, air is discharged toward the left and right side directions of the body 50. At the same time, by a suction fan (not shown), the polluted air is taken in to the suction guide 110. Thus, the air density at a front portion of the suction guide 110 is lowered, and the air discharged by the swirler fan 70 is circulated toward a center of the cooking unit 60. A swirl is generated as the air is spiraled.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A ventilation apparatus comprising:

a housing mountable on an upper surface of a body, the housing configured in an upward direction from a horizontal cooking surface on the upper surface of the body;

a suction port case disposed inside the housing, the suction port case including a suction port configured to guide, in a first direction, polluted air generated during cooking;

a passage connected to the suction port and through which the polluted air passes;

an exit port connected to the passage and configured to discharge the polluted air to an outside of the ventilation apparatus;

a first pair of discharging port cases disposed inside the housing and spaced apart on lateral sides of the suction port case, the first pair of discharging port cases each having a corresponding discharging port configured to guide a first portion of purified air in a second direction opposite to the first direction, the first pair of discharging port cases each having the corresponding discharging port and a corresponding swirl generating unit, the first pair of discharging port cases configured to discharge the first portion of purified air in a third direction perpendicular to the first direction, the corresponding swirl generating unit is disposed on a front of the corresponding discharging port, the corresponding swirl generating unit having a unit body and a plurality of first discharging holes penetratively formed through the unit body, wherein the plurality of first discharging holes are formed in a slanted manner away from the suction port and are configured to discharge the first portion of purified air toward an outer lateral side surface of the housing such that the first portion of purified air is directed away from a center of the suction port; and a discharging unit including a second pair of discharging ports perpendicular to the first pair of discharging ports, the second pair of discharging ports each comprising a corresponding plate and a corresponding plurality of second discharging holes penetratively formed through the corresponding plate, and wherein the corresponding plurality of second discharging holes are formed in a slanted manner toward the first pair of discharging ports and are configured to discharge a second portion of purified air upward toward the suction port.

2. The ventilation apparatus of claim 1, further comprising:

at least one swirler fan mounted at the suction port to generate a swirl at a front of the suction port so that the polluted air is taken in.

3. A ventilation apparatus comprising:

a housing mountable on an upper surface of a body to be configured in an upward direction from a horizontal cooking surface on the upper surface of the body;

a suction port case disposed inside the housing, the suction port case including a suction port configured to guide, in a first direction, polluted air generated during cooking;

a suction fan configured to generate a suction force so that the polluted air is taken in through the suction port;

a passage connected to the suction port and through which the polluted air passes;

a first pair of discharging port cases disposed inside the housing and spaced apart on lateral sides of the suction port case, the first pair of discharging port cases each having a corresponding discharging port configured to guide a first portion of purified air in a second direction opposite to the first direction, the first pair of discharging port cases each having the corresponding discharging port and a corresponding swirl generating unit, the first pair of discharging port cases configured to discharge the first portion of purified air in a third direction perpendicular to the first direction, the corresponding swirl generating unit is disposed on a front of the corresponding discharging port and configured to generate a swirl at a front of the suction port, the corresponding swirl generating unit having a unit body and a plurality of first discharging holes penetratively formed through the unit body, wherein the plurality of first discharging holes are formed in a slanted manner away from the suction port and are configured to discharge the first portion of purified air toward an outer lateral side surface of the housing such that the first portion of purified air is directed away from a center of the suction port; and a discharging unit including a second pair of discharging ports perpendicular to the first pair of discharging ports, the second pair of discharging ports each comprising a corresponding plate and a corresponding plurality of second discharging holes penetratively formed through the corresponding plate, wherein the plurality of first discharging holes are configured to discharge air in a first direction toward an outer side of a lateral side surface of the housing such that the air is directed away from a center of the suction port; and wherein the corresponding plurality of second discharging holes are formed in a slanted manner toward the first pair of discharging ports and are configured to discharge a second portion of purified air upward toward the suction port.

4. The ventilation apparatus of claim 3, wherein the passage is formed in a way to discharge the polluted air, which is introduced into the suction port and purified by at least one filter, from the swirl generating unit by a discharge pressure of the suction fan as the first portion of purified air.

5. The ventilation apparatus of claim 3, wherein the passage is formed in a way that the polluted air, which is introduced into the suction port and purified by at least one filter, is discharged from the discharging unit by a discharge pressure of the suction fan as the second portion of the purified air.

* * * * *